US011339023B2

(12) United States Patent
Kanzawa

(10) Patent No.: US 11,339,023 B2
(45) Date of Patent: May 24, 2022

(54) IMAGE FORMING APPARATUS

(71) Applicant: Oki Electric Industry Co., Ltd., Tokyo (JP)

(72) Inventor: Naoki Kanzawa, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/180,600

(22) Filed: Feb. 19, 2021

(65) Prior Publication Data

US 2021/0261377 A1 Aug. 26, 2021

(30) Foreign Application Priority Data

Feb. 25, 2020 (JP) ..... JP2020-029156

(51) Int. Cl.
*B65H 35/00* (2006.01)
*G03G 15/00* (2006.01)

(52) U.S. Cl.
CPC ..... *B65H 35/0086* (2013.01); *G03G 15/6523* (2013.01)

(58) Field of Classification Search
None
See application file for complete search history.

(56) References Cited

U.S. PATENT DOCUMENTS 3,075,493 A * 1/1963 Lewis ..... B26D 5/32 118/699
3,639,053 A * 2/1972 Spear, Jr. ..... B65H 35/04 399/385
3,673,905 A * 7/1972 Kono ..... G03G 15/6523 83/175
3,834,963 A * 9/1974 Hoffman ..... B65C 9/1819 156/215
3,884,103 A * 5/1975 Namba ..... G03G 15/6523 83/156

(Continued)

FOREIGN PATENT DOCUMENTS

JP 60049350 A * 3/1985 ..... G03G 15/6523
JP 2018-167349 A 11/2018

OTHER PUBLICATIONS

Espacenet machine translation of JP60049350; http://translationportal.epo.org/emtp/translate/?ACTION=description-retrieval&COUNTRY=JP&ENGINE=google&FORMAT=docdb&KIND=A&LOCALE=en_EP&NUMBER=S6049350&OPS=ops.epo.org/3.2&SRCLANG=ja&TRGLANG=en (Year: 1985).*

*Primary Examiner* — Leslie A Nicholson, III
(74) *Attorney, Agent, or Firm* — Muncy, Geissler, Olds & Lowe, P.C.

(57) ABSTRACT

An image forming apparatus includes a cutting part cutting a medium, a transfer part arranged on a downstream side of the cutting part in a carrying direction and transfers a developer image to the medium; a flexure forming part having a guide part and forms a flexure of the medium by bending the medium between the cutting part and the transfer part in the carrying direction; and an opposing part that is arranged opposing the flexure forming part via a carrying path through which the medium is carried, wherein the guide part performs a retreat movement either before or after the cutting part starts to cut the medium, wherein the retreat movement is a movement of the guide part in which the guide part moves in a direction away from the opposing part.

12 Claims, 16 Drawing Sheets

(56) References Cited

U.S. PATENT DOCUMENTS 4,013,357 A * 3/1977 Nakajima ..... G03G 15/6523 399/387
4,046,470 A * 9/1977 Yamamoto ..... G03G 15/6523 399/387
4,561,928 A * 12/1985 Malthouse ..... B26D 1/385 156/497
6,519,441 B1 * 2/2003 Sawada ..... B41J 11/48 399/384
6,633,740 B2 * 10/2003 Estabrooks ..... B41J 11/42 399/299

* cited by examiner

IMAGE FORMING APPARATUS

TECHNICAL FIELD

The present invention relates to an image forming apparatus, particularly an image forming apparatus that includes a cutter for cutting a roll sheet and performs printing by cutting the roll sheet with the cutter.

BACKGROUND

Conventionally, there has been an apparatus having a cutting part that cuts a medium on an upstream side of a transfer part in a carrying direction (see, for example, Patent Document 1).

RELATED ART

[Patent Doc. 1] JP Laid-Open Patent Application Publication 2018-167349

Subject(S) to be Solved

In such an apparatus, it is desirable to avoid influence of movement of the cutting part during cutting on transfer in the transfer part.

SUMMARY

An image forming apparatus disclosed in the application includes a cutting part that cuts a medium, the medium being carried along a carrying path in a carrying direction; a transfer part that is arranged on a downstream side of the cutting part in the carrying direction of the medium and transfers a developer image to the medium; a flexure forming part that has a guide part for guiding the medium to be carried along the carrying path, and forms a flexure of the medium by bending the medium between the cutting part and the transfer part in the carrying direction; and an opposing part that is arranged opposing the flexure forming part via a carrying path through which the medium is carried, wherein the guide part performs a retreat movement either before or after the cutting part starts to cut the medium, wherein the retreat movement is a movement of the guide part in which the guide part moves in a direction away from the opposing part.

An image forming apparatus, disclosed in the application, includes a cutting part that cuts a medium; a transfer part that is arranged on a downstream side of the cutting part in a carrying direction of the medium and transfers a developer image to the medium; and a flexible member that guides the medium and forms a flexure of the medium between the cutting part and the transfer part in the carrying direction.

According to the present invention, a flexure formed in the medium acts as a buffering part, and movement of the cutting part when the medium is cut can be prevented from affecting the transfer part.

BRIEF DESCRIPTION OF THE DRAWINGS

FIG. 6A illustrates a state when cutting of a roll sheet has not been performed. FIG. 6B illustrates a state when the cutting of the roll sheet is performed.

FIG. 7A illustrates a state when a thick roll sheet is used and cutting has not been performed. FIG. 7B illustrates a state when a thin roll sheet is used and cutting has not been performed.

FIG. 8A illustrates a state when cutting of the roll sheet has not been performed. FIG. 8B illustrates a state when cutting of the roll sheet is performed.

FIG. 9A illustrates a state when cutting of the roll sheet has not been performed. FIG. 9B illustrates a state when cutting of the roll sheet is performed.

FIG. 14A illustrates a state when a thick roll sheet is used and cutting has not been performed. FIG. 14B illustrates a state when a thin roll sheet is used and cutting has not been performed.

FIG. 15A illustrates a state when cutting of the roll sheet has not been performed. FIG. 15B illustrates a state when cutting of the roll sheet is performed.

FIG. 16A illustrates a state when cutting of the roll sheet has not been performed. FIG. 16B illustrates a state when cutting of the roll sheet is performed.

DETAILED DESCRIPTION OF THE PREFERRED EMBODIMENT(S)

First Embodiment

Figure 1:
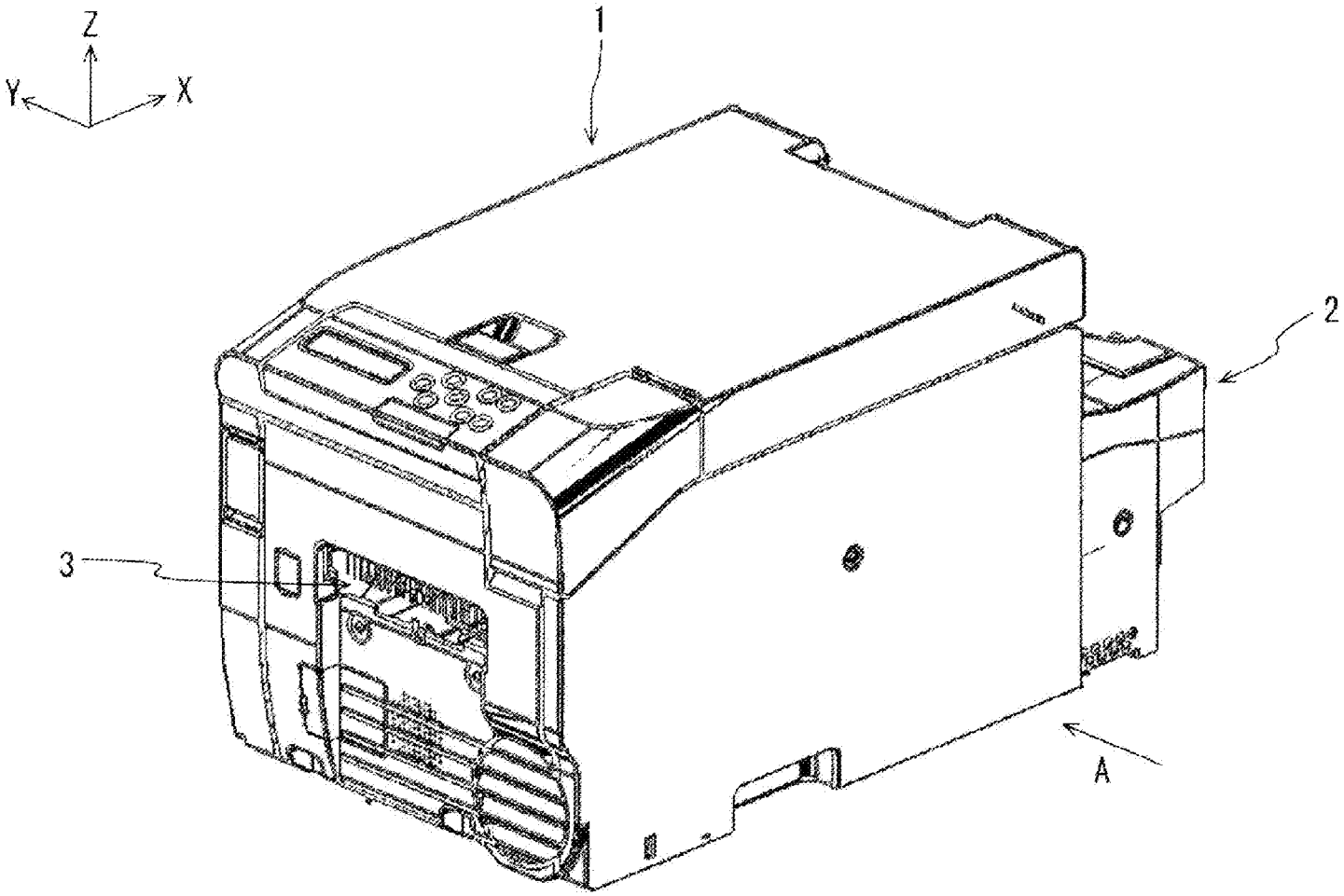
FIG. 1 is an external perspective view of an image forming apparatus of a first embodiment of the present invention.
Figure 2A:
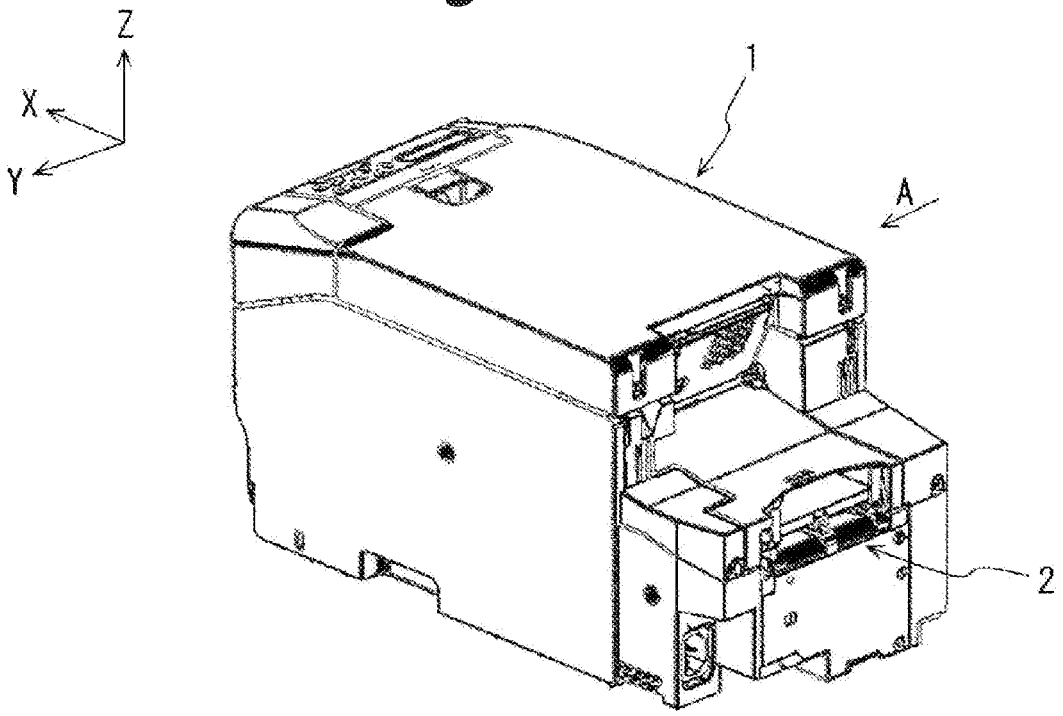
FIGS. 2A and 2B are respectively external perspective views of the image forming apparatus viewed from angles different from that of FIG. 1.
Figure 2B:
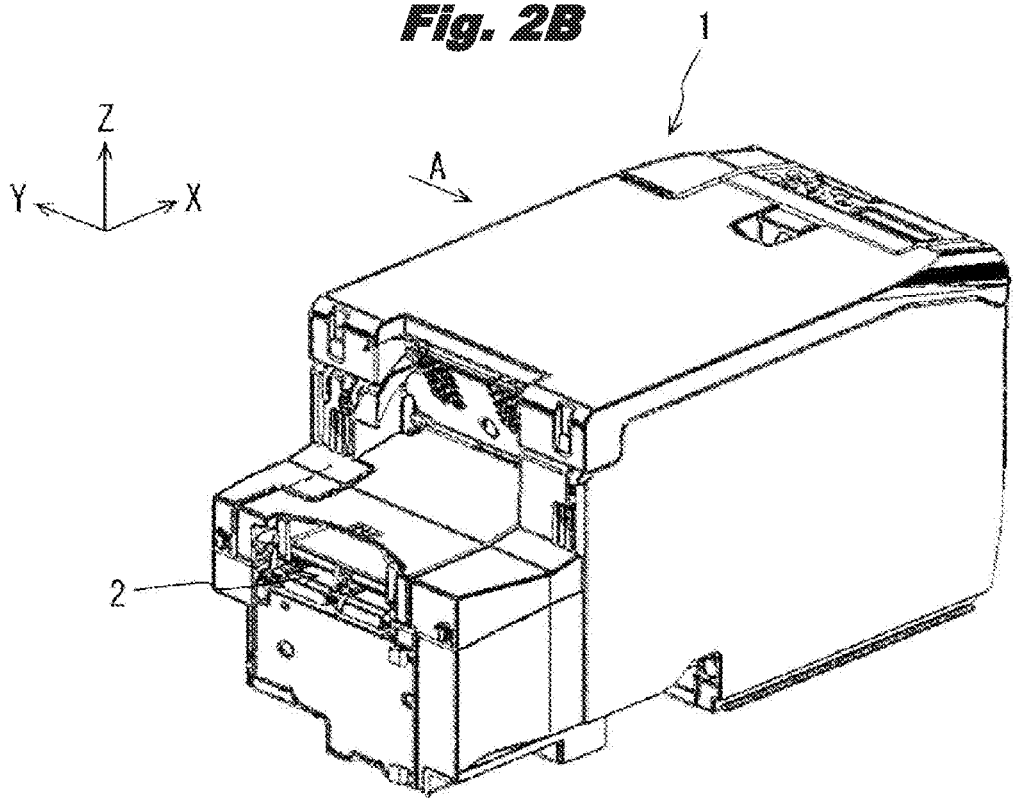

FIG. 1 is an external perspective view of an image forming apparatus 1 of a first embodiment of the present invention. FIGS. 2A and 2B are respectively external perspective views of the image forming apparatus 1 viewed from angles different from that of FIG. 1.

As illustrated in the drawings, the image forming apparatus 1 includes a roll sheet carry-in port 2 and an ejection port 3. A roll sheet supplied from an external device (not illustrated in the drawings) is carried to the roll sheet carry-in port 2. When the roll sheet supplied from the external device (not illustrated in the drawings) is carried in, the roll sheet is sequentially cut to a predetermined length. The cut roll sheet is used as a recording sheet. Printing is performed with respect to the cut roll sheet (that is, recording sheet) according to the order it is carried in. A printed recording sheet is ejected from the ejection port 3 to an external sheet stocker (not illustrated in the drawings).

Figure 3:
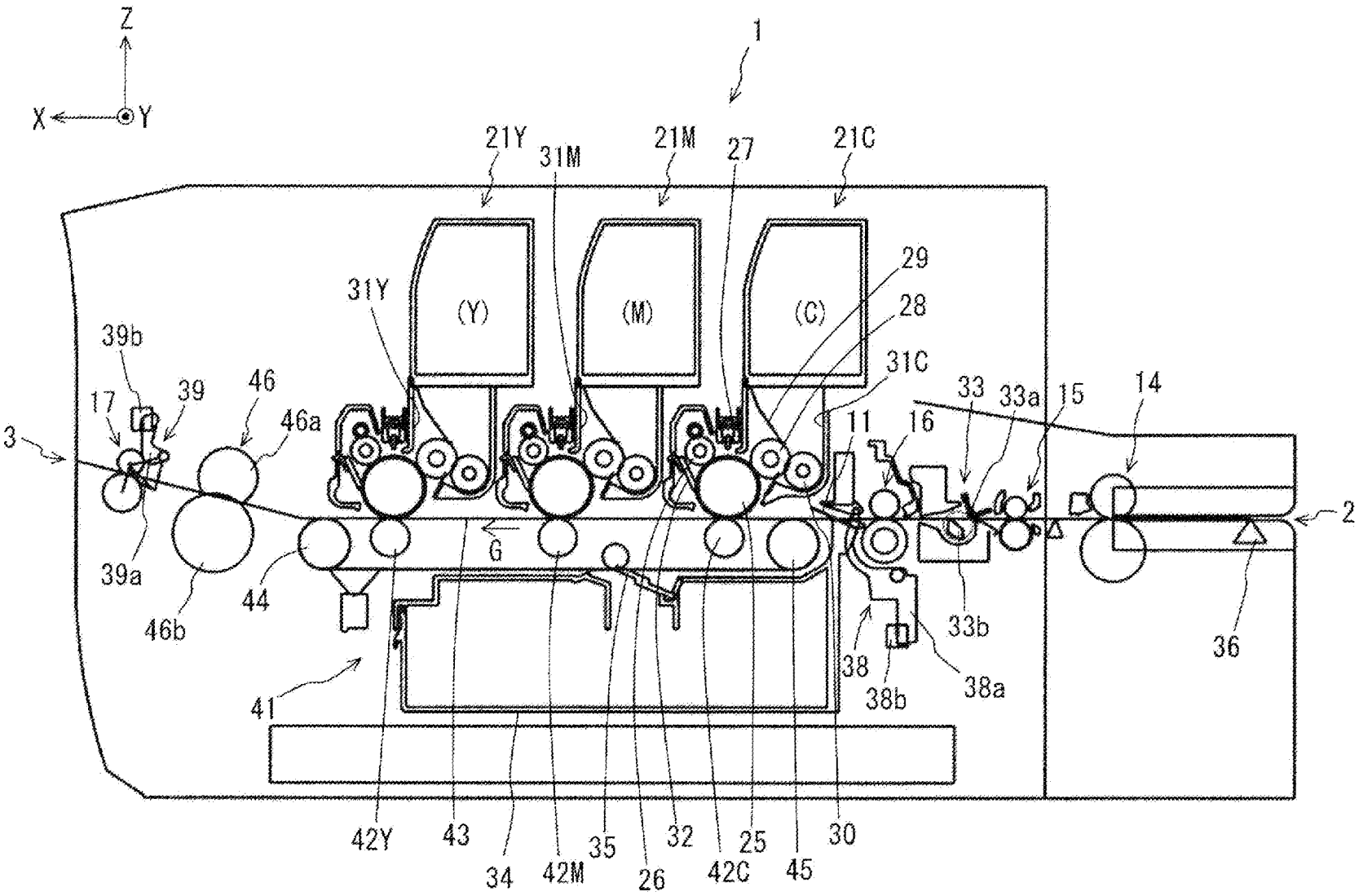
FIG. 3 is a main part configuration diagram schematically illustrating an internal configuration of the image forming apparatus as viewed from an arrow A direction in FIG. 1.

FIG. 3 is a main part configuration diagram schematically illustrating an internal configuration of the image forming apparatus 1 as viewed from an arrow A direction (FIG. 1).

As illustrated in FIG. 3, the image forming apparatus 1 has a configuration of an electrophotographic printer. A generally linear sheet carrying path is formed including carrying roller pairs 14, 15, a feed roller pair 16, and an ejection roller pair 17. At an upstream end part of the sheet carrying path, a sheet set sensor 36 is arranged that detects that a roll sheet 18 (see FIG. 5) as a medium supplied from an external device via the roll sheet carry-in port 2 has been set, and at a downstream end part, an ejection roller pair 17 is arranged that ejects a recording sheet 18' (to be described later) to the outside via the ejection port 3.

In the sheet carrying path, the carrying roller pairs 14, 15 that carry a roll sheet 18 fed in, the feed roller pair 16, a transfer belt unit 41 that carries a roll sheet 18 carried in by the feed roller pair 16 by causing the roll sheet 18 to adhere to a transfer belt 43 by an electrostatic effect, and a fuser 46 that fuses a toner image onto the roll sheet 18 are arranged.

Further, on a downstream side of the carrying roller pair 14 in the sheet carrying direction, a cutter unit 33 is arranged that includes the carrying roller pair 15, a fixed blade 33*a* and a rotary blade 33*b* and cuts the roll sheet 18. On a downstream side of the feed roller pair 16, a write sensor 38 is arranged that detects a leading edge of the roll sheet 18 carried in and outputs a detection signal as an exposure trigger of an exposure device 27 (to be described later). On a downstream side of the write sensor 38, a slack forming film 11 is arranged that forms a slack in the roll sheet 18 carried in. The slack forming film 11 will be described in detail later.

Further, on a downstream side of the fuser 46, an ejection sensor 39 is arranged that detects ejection of a recording sheet 18' that has been cut and on which printing has been performed. Hereinafter, a roll sheet 18 that has been cut by the cutter unit 33 may be referred to as a recording sheet 18'.

In the present embodiment, the cutter unit 33 uses a rotary cutter that includes the rotary blade 33*b* rotating in a sheet traveling direction (counterclockwise in FIG. 3) and the fixed blade 33*a* opposing the rotary blade 33*b*. Further, the write sensor 38 includes an optical sensor 38*b* and a lever 38*a*, and is a photo-interrupter configured to be in a state of blocking or in a state of transmitting light directed to the optical sensor 38*b* when the recording sheet 18' rotates the lever.

The transfer belt unit 41 includes: transfer rollers 42C, 42M, 42Y (which may be simply referred to as transfer rollers 42 when it is not necessary to particularly distinguish between them); the transfer belt 43 that is arranged so as to be capable of traveling in an arrow G direction in FIG. 3 in a state of being stretched by a drive roller 44 and a tension roller 45; a belt cleaner 35 that scrapes off a toner image remaining on the transfer belt 43; and a waste toner container 34 that contains the toner scraped off by the belt cleaner 35.

An image forming unit 21C containing a cyan (C) toner, an image forming unit 21M containing a magenta (M) toner, and an image forming unit 21Y containing a yellow (Y) toner (the image forming units 21C, 21M, 21Y are referred to as image forming units 21 when it is not necessary to particularly distinguish between them) are arranged in a row in this order from an upstream side in the carrying direction of the recording sheet 18' at positions where the recording sheet 18' is sandwiched, the recording sheet 18' adhering to the transfer belt 43 and being carried by the transfer belt unit 41.

In the present embodiment, the image forming units 21C, 21M, 21Y are detachably arranged with respect to a main body of the image forming apparatus 1. Further, since these image forming units have the same configuration, an internal structure of each of the image forming units is described below using the image forming unit 21C as an example. With respect to configuration elements of the image forming apparatus 1 such as the image forming units 21 of the image forming apparatus 1, a portion excluding the configuration elements may be referred to as the main body of the image forming apparatus 1.

Arranged in the image forming unit 21C are: a photosensitive drum 25; a charging roller 26 uniformly charging a surface of the photosensitive drum 25; a development roller 28 forming a toner image by adhering toner to an electrostatic latent image formed on the surface of the photosensitive drum 25; a development blade 29; a supply roller 30 pressed against the development roller 28; and the like.

The supply roller 30 is a roller that supplies toner contained in a final toner container 31C to the development roller 28. The development blade 29 is pressed against the development roller 28. The development blade 29 is for causing the toner supplied from the supply roller 30 onto the development roller 28 to form a thin layer. The cleaning blade 32 pressed against the surface of the photosensitive drum 25 scrapes off toner (residual toner) remaining on the photosensitive drum 25 after transfer (to be described later).

Above the photosensitive drum 25, an exposure device 27 is arranged at a position opposing the photosensitive drum 25. The exposure device 27 exposes the photosensitive drum 25 according to image data of the corresponding color and forms an electrostatic latent image on the surface of the photosensitive drum 25.

Each of the transfer rollers 42 of the transfer belt unit 41 is arranged so as to be pressed against the corresponding photosensitive drum 25 via the transfer belt 43, and, in this nip part, charges the recording sheet 18' with a polarity opposite to that of the toner and transfers a toner image formed on the corresponding photosensitive drum 25 to the recording sheet 18'. Therefore, here, the nip part between the photosensitive drum 25 and the transfer roller 42 corresponds to a transfer part.

The fuser 46 heats and melts toner on the recording sheet 18', which is carried between a heat application roller 46*a* and a pressure application roller 46*b* along the sheet carrying path and on which a toner image has been transferred, and fuses the toner image onto the recording sheet 18'. The ejection sensor 39 monitors occurrence of jamming in the fuser 46 or winding of the recording sheet 18' to the heat application roller or the like, and the ejection roller pair 17 ejects a printed recording sheet 18', which is ejected from the fuser 46 after a toner image is fused thereonto, to the outside of the apparatus.

Similar to the write sensor 38, the ejection sensor 39 includes an optical sensor 39*b* and a lever 39*a*, and is a photo-interrupter configured to be in a state of blocking or in a state of transmitting light directed to the optical sensor 39*b* when the recording sheet 18' rotates the lever 39*a*.

For X, Y, and Z axes in FIG. 1, the carrying direction when the recording sheet 18' passes through the image forming units 21 is taken as the X axis, a rotation axis direction of the photosensitive drums 25 is taken as the Y axis, and a direction orthogonal to both the X and Y axes is taken as the Z axis. Further, when the X, Y, and Z axes are shown in other drawings, the directions of these axes indicate common directions. That is, the X, Y, and Z axes in each drawing indicate arrangement directions when depicted portions in the each drawing form the image forming apparatus 1 illustrated in FIG. 3. Further, here, arrangement is performed such that the Z axis is in a substantially vertical direction.

Figure 4:
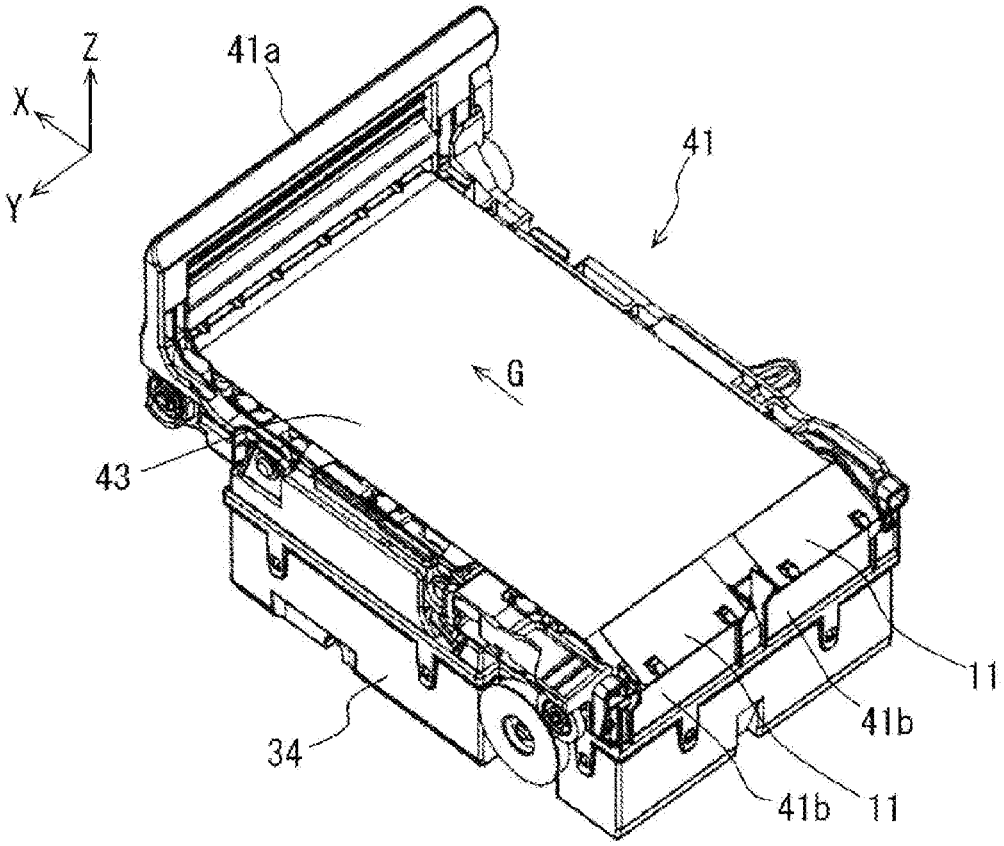
FIG. 4 is an external perspective view of a transfer belt unit of the first embodiment.

FIG. 4 is an external perspective view of the transfer belt unit 41 described above. As illustrated in FIG. 4, the transfer belt unit 41 has the transfer belt 43 that carries the recording sheet 18' placed on an upper surface thereof in an arrow G direction (plus direction of the X axis); on an ejection side end part of the transfer belt unit 41, a handle 41*a* for holding a main body of the transfer belt unit 41 is arranged; and a receiving side end part of the transfer belt unit 41, the slack forming film 11 is attached to a casing 41*b* of the transfer belt unit 41.

The slack forming film 11 as a flexible member includes a pair of rectangular members arranged along a rotation axis direction of the drive roller 44 (FIG. 3) (the Y axis direction). One end of each long side of each of the rectangular members is attached to the casing 41*b* of the transfer belt unit 41 such that the other end (front end) of each long side protrudes from a lower side to an upper side of the sheet carrying path and toward a downstream side in the sheet carrying direction.

Figure 5:
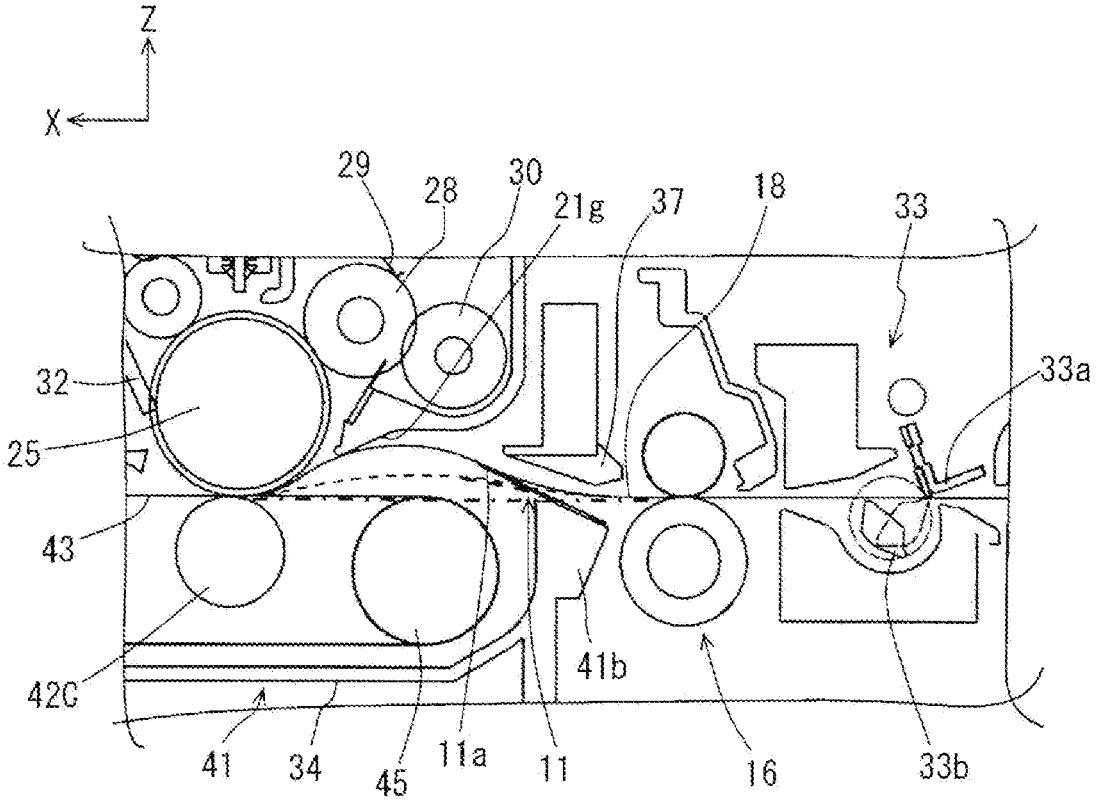
FIG. 5 is an enlarged view of a portion around a slack forming film in FIG. 3 and is a diagram for describing an operation of the slack forming film.

FIG. 5 is an enlarged view of a portion around the slack forming film 11 in FIG. 3 and is a diagram for describing an operation of the slack forming film 11.

The roll sheet 18 passes through the cutter unit 33 as a cutting part, the feed roller pair 16, and the slack forming film 11 as a flexure forming part along the sheet carrying path, and reaches the nip part (transfer part) between the photosensitive drum 25 and the transfer roller 42C, and a cyan (C) toner image is transferred to the roll sheet 18, and after that, magenta (M) and yellow (Y) toner images are sequentially superimposed and transferred to the roll sheet 18. The roll sheet 18 is cut by the cutter unit 33 while the transfer is being performed, and becomes the recording sheet 18', and is ejected from the ejection port 3 (FIG. 3).

Here, a process is considered in which a leading edge part of the cut roll sheet 18 again passes through the feed roller pair 16 and the slack forming film 11 and reaches the nip part between the photosensitive drum 25 and the transfer roller 42C.

A partial carrying path when assuming a case where, excluding the slack forming film 11, the roll sheet 18 carried by the feed roller pair 16 is carried straight ahead and is placed on the transfer belt 43 and reaches the nip part between the photosensitive drum 25 and the transfer roller 42C may be hereinafter referred to as a virtual carrying path (indicated by a one-dot chain line in FIG. 5).

In this case, the roll sheet 18 is carried by the carrying roller pairs 14, 15 (FIG. 3), and the leading edge part of the roll sheet 18 is eventually carried through the feed roller pair 16 and becomes in contact with on the slack forming film 11 which is arranged inclined with respect to the virtual carrying path. The leading edge part guided obliquely upward (with respect to the arrow G direction) by the slack forming film 11 is guided obliquely downward by a traveling guide 37 and a bottom outer side curved surface 21*g* of the image forming unit 21C to reach the nip part (transfer part) between the photosensitive drum 25 and the transfer roller 42C. Therefore, the bottom outer side curved surface 21*g* of the image forming unit 21C has a curved shape such that the leading edge part of the abutting roll sheet 18 is guided toward the nip part.

A portion fixed on an opposite side with respect to the slack forming film 11 as a flexure forming part via the sheet carrying path, such as the image forming unit 21 and the traveling guide 37, corresponds to an opposing part.

Since the leading edge part of the roll sheet 18 reaches the nip part via the path as described above, due to its own weight or characteristics such as viscosity of the roll sheet 18, as indicated by a solid line in FIG. 5, the roll sheet 18 continues to be carried while maintaining a state of being bent upward with respect to the virtual carrying path.

Here, a roll sheet cutting operation by the cutter unit 33 is briefly described. The cutter unit 33 includes the fixed blade 33*a*, which is arranged on an upper side of the sheet carrying path and extends in a width direction of the roll sheet 18 to be carried, and the rotary blade 33*b*, which is arranged on a lower side of the sheet carrying path and is formed in a spiral shape with respect to a rotation axis thereof.

The roll sheet 18 is cut at a sliding point between the fixed blade 33*a* and the rotating rotary blade 33*b*, the sliding point continuously moving in the width direction of the roll sheet 18. Further, the cutting is performed while the roll sheet 18 is being carried along the sheet carrying path. Therefore, the extending direction of the fixed blade 33*a* and the rotation axis direction of the rotary blade 33*b* are arranged inclined with respect to the sheet carrying direction such that a cut side of the roll sheet 18 is perpendicular to the carrying direction (see FIG. 10).

Hereinafter, the cut by the cutter unit 33 with respect to the roll sheet 18 while being carried may be referred to as a traveling cut. During the traveling cut, a load is generated with respect to the carrying of the roll sheet 18, and a movement speed of the roll sheet 18 that moves the cutter unit 33 varies in a slowing down direction. Simply speaking, the movement speed becomes slow while the cutter unit bits the roll sheet.

In FIG. 5, a solid line indicates a curved traveling path of the roll sheet 18 when the traveling cut by the cutter unit 33 has not been performed, and a dotted line indicates a traveling path of the roll sheet 18 when the traveling cut by the cutter unit 33 is performed and when the movement speed of the roll sheet 18 changes in a slowing down direction.

As illustrated by the dotted line in FIG. 5, during the traveling cut by the cutter unit 33, due to that the movement of the roll sheet 18 passing through the cutter unit 33 is slowed down, a tensional force of a curved portion is increased. However, as a result, as illustrated by the dotted line, a guide part 11*a* of the slack forming film 11 as a flexible member virtual is displaced so as to bend toward the virtual carrying path side to absorb the change in the movement of the roll sheet 18.

As a result, the change in the speed of the roll sheet 18 occurring in the cutter unit 33 is adsorbed by the displacement of the slack forming film 11, and the influence thereof on the nip part between the photosensitive drum 25 and the transfer roller 42C is suppressed, the nip part being a transfer part of a toner image.

First Modified Embodiment of First Embodiment

Figure 6A:
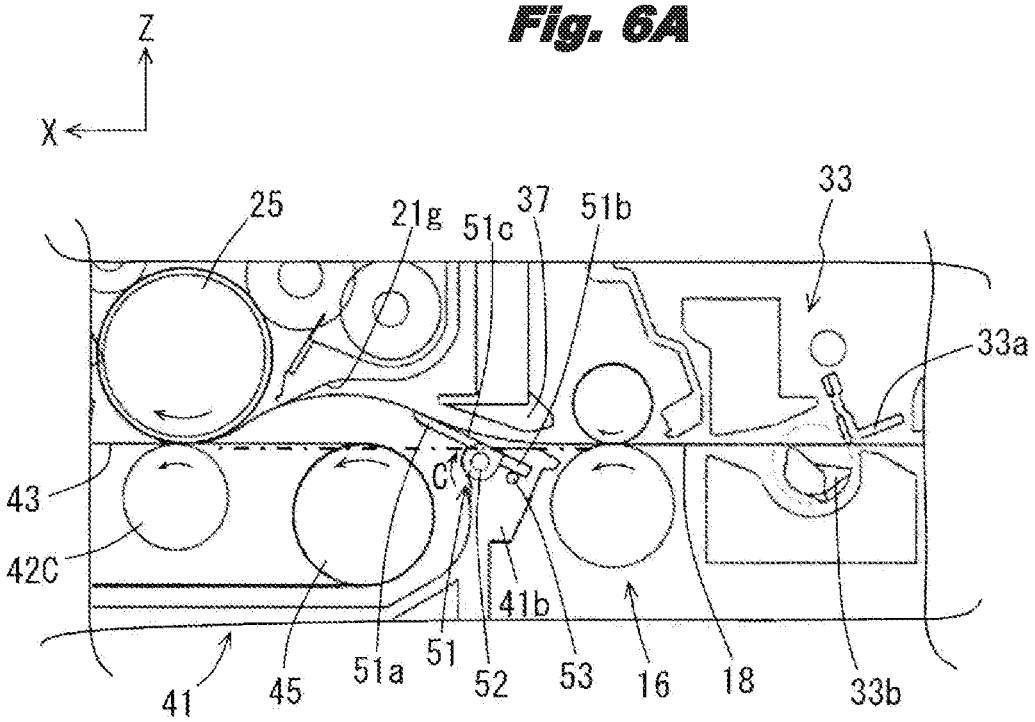
FIGS. 6A and 6B are main part configuration diagrams illustrating a configuration and operating states of a first modified embodiment of the first embodiment.
Figure 6B:
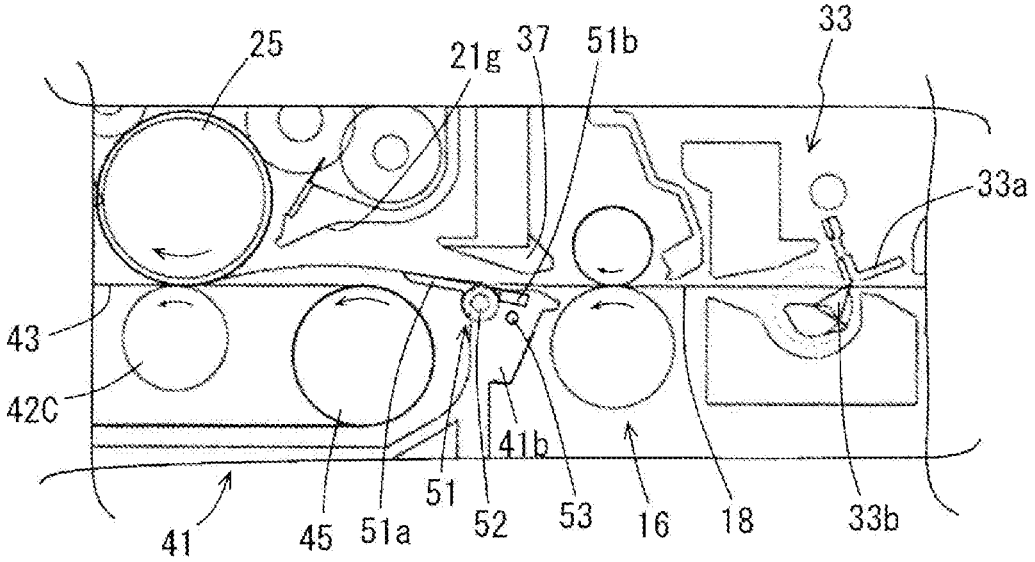

FIGS. 6A and 6B are main part configuration diagrams illustrating a configuration and operating states of a first modified embodiment of the first embodiment. FIG. 6A illustrates a state when the traveling cut of the roll sheet 18 by the cutter unit 33 has not been performed. FIG. 6B illustrates a state when the traveling cut of the roll sheet 18 is performed. The configuration of the first modified embodiment is different from the configuration of the first embodiment illustrated in FIG. 5, for example, in that a slack forming guide 51 as a guide member is arranged instead of the slack forming film 11.

That is, in the first modified embodiment, the slack forming guide 51 having a width substantially equal to that of the rolled sheet 18 to be carried is rotatably supported by the caching 41*b* of the transfer belt unit 41 so as to be rotatable around an axis extending in the Y axis. A position where the slack forming guide 51 is rotatably supported is near a lower side of the virtual carrying path (indicated by a one-dot chain line in FIG. 6A), and it is designed such that, when a guide surface 51*c* of the slack forming guide 51 becomes horizontal, it substantially overlaps with the virtual carrying path.

Further, as illustrated in FIG. 6A, the slack forming guide 51 as a flexure forming part is biased in an arrow C direction (clockwise direction), for example, by a torsion spring (not illustrated in the drawings) arranged on a rotation shaft 52, and, at a predetermined rotation position where the guide surface 51*c* protrudes from a lower side to an upper side of the virtual carrying path and to a downstream side in the sheet carrying direction, a rear end part 51*b* of the slack forming guide 51 becomes in contact with an engaging member 53 as a restriction member, and movement in the arrow C direction is restricted.

Similar to the above description with reference to FIG. 5, FIG. 6A illustrates a state in which, after the leading edge part of the cut roll sheet 18 passes through the feed roller pair 16 and the slack forming guide 51 and reaches the nip part (transfer part) between the photosensitive drum 25 and the transfer roller 42C, the roll sheet 18 continues to be carried while maintaining a state of being bent (curved) upward with respect to the virtual carrying path.

On the other hand, FIG. 6B illustrates a traveling path during the traveling cut by the cutter unit 33 when the movement speed of the roll sheet 18 changes in a slowing down direction and illustrates a rotation state of the slack forming guide 51. In this way, during the traveling cut by the cutter unit 33, a tensional force of a curved portion is increased due to that the movement of the roll sheet 18 passing through the cutter unit 33 is slowed. However, as a result, the slack forming guide 51 rotates counterclockwise (in a direction opposite to the arrow C) against a biasing force and is displaced so as to absorb the change in the movement of the roll sheet 18. Here, a portion of the guide surface 51*c* of the slack forming guide 51 that guides the roll sheet 18 corresponds to a guide part.

Second Modified Embodiment of First Embodiment

Figure 7A:
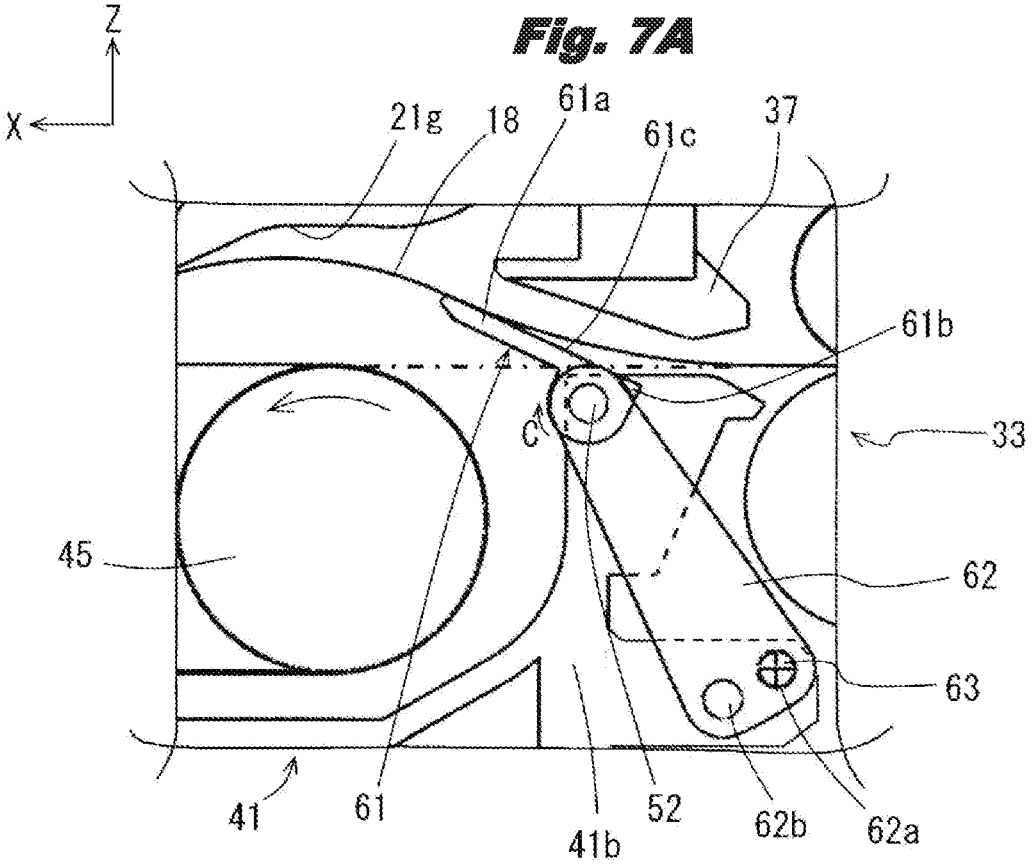
FIGS. 7A and 7B are main part configuration diagrams illustrating a configuration of a second modified embodiment of the first embodiment.
Figure 7B:
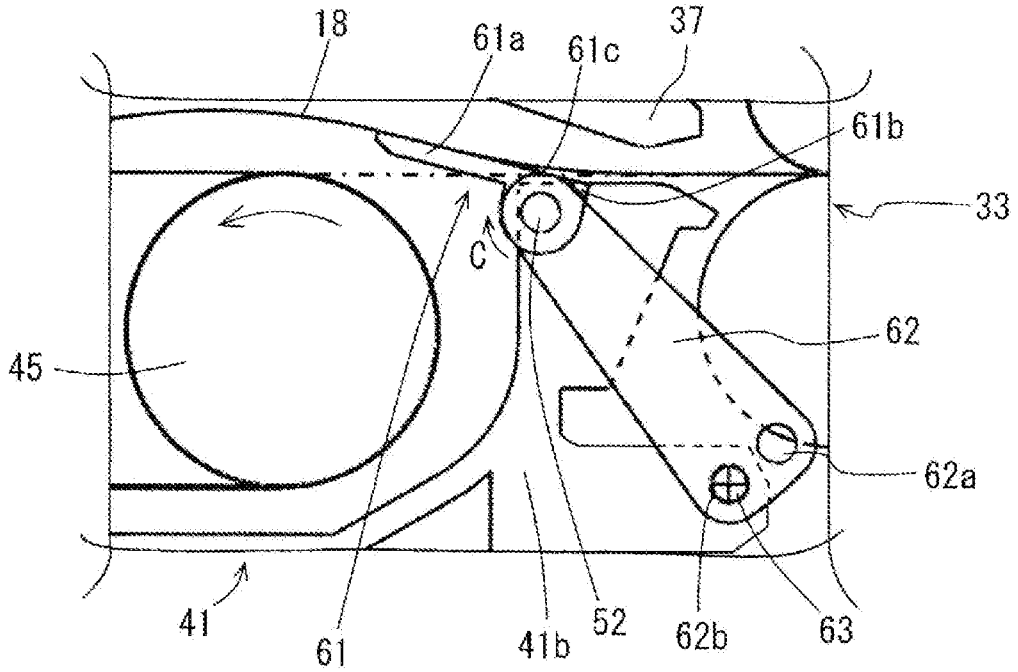

FIGS. 7A and 7B are main part configuration diagrams illustrating a configuration of a second modified embodiment of the first embodiment. FIG. 7A illustrates a state when a thick roll sheet 18 is used and a traveling cut has not been performed. FIG. 7B illustrates a state when a thin roll sheet 18 is used and a traveling cut has not been performed. The configuration of the second modified embodiment is different from the configuration of the first modified embodiment illustrated in FIGS. 6A and 6B, for example, in that a home position of the slack forming guide 51 can be adjusted.

That is, in the second modified embodiment, a protrusion 61*b* formed on a rear end part of a slack forming guide 61, which is biased in the arrow C direction, becomes in contact with a side surface of a restriction plate 62 as a restriction member and movement in the arrow C direction is restricted at a predetermined rotation position. Hereinafter, this rotation position at which the movement is restricted may be referred to as the home position of the slack forming guide 61.

The restriction plate 62 is rotatably held with the rotation shaft 52 of the slack forming guide 61 as a rotation shaft. Further, the restriction plate 62 has a first adjustment hole 62*a* and a second adjustment hole 62*b* at different positions in a circumferential direction around the rotation shaft 52. The first adjustment hole 62*a* and the second adjustment hole 62*b* are selectively fixed by a locking screw 63, for example, to the caching 41*b* of the transfer belt unit 41.

As illustrated in FIG. 7A, the first adjustment hole 62*a* is formed at a position where, when fixed by the locking screw 63, an inclination angle of the guide surface 61*c* of the slack forming guide 61 with respect to the virtual carrying path at the first home position in this case becomes large, and the slack of the roll sheet 18 to be carried becomes relatively large.

On the other hand, as illustrated in FIG. 7B, the second adjustment hole 62*b* is formed at a position where, when fixed by the locking screw 63, an inclination angle of the guide surface 61*c* of the slack forming guide 61 with respect to the virtual carrying path at the second home position in this case becomes small, and the slack of the roll sheet 18 to be carried becomes relatively small.

As will be described later, when the roll sheet 18 is a thick sheet, the first adjustment hole 62*a* is selected as a locking hole so that the slack of the rolled sheet 18 to be carried is relatively large, and when the roll sheet 18 is a thin sheet, the second adjustment hole 62*b* is selected as a locking hole so that the slack of the roll sheet 18 to be carried is small. Here, the slack forming guide 61 and the restriction plate 62 correspond to a flexure forming part.

Figure 8A:
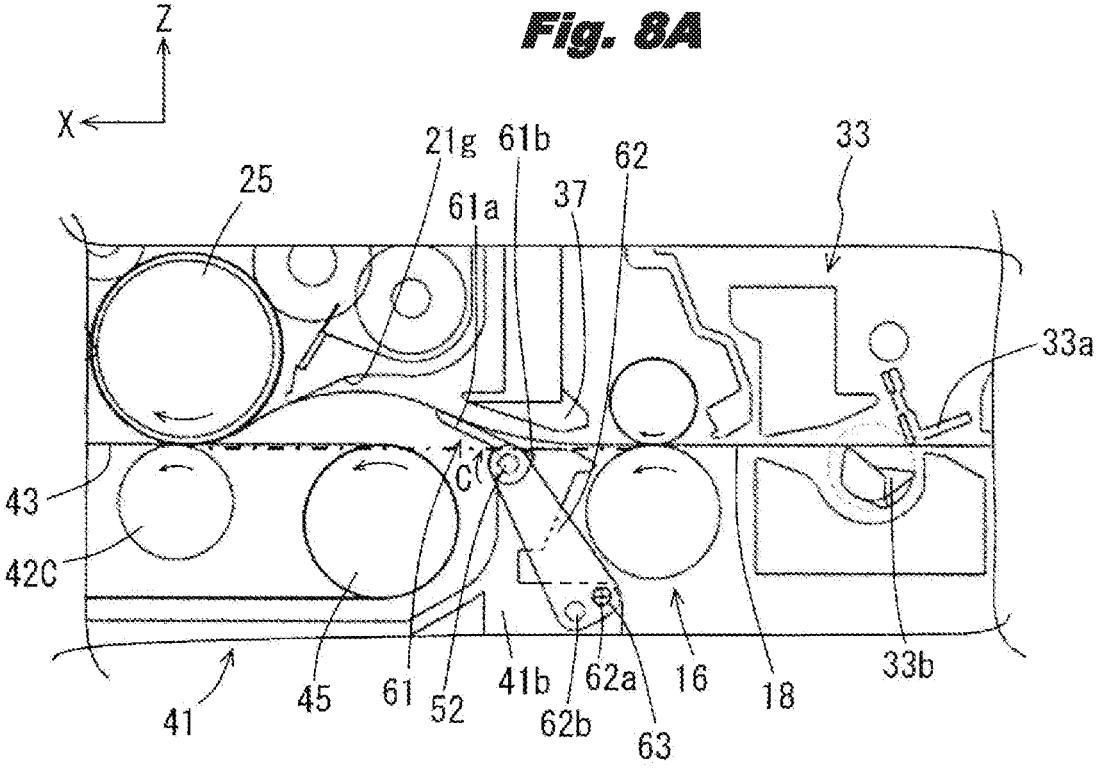
FIGS. 8A and 8B are main part configuration diagrams illustrating a configuration and operating states in the case where a thick roll sheet is used.
Figure 8B:
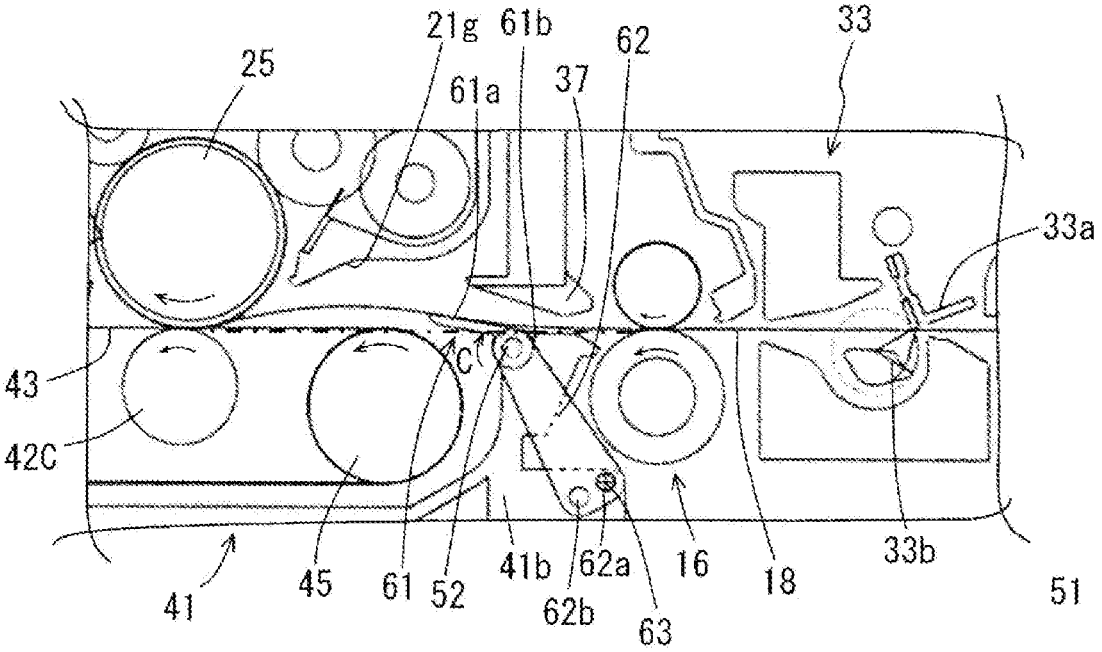

FIGS. 8A and 8B are main part configuration diagrams illustrating a configuration and operating states in the case where a thick roll sheet 18 is used. FIG. 8A illustrates a state when the traveling cut of the roll sheet 18 has not been performed. FIG. 8B illustrates a state when the traveling cut of the roll sheet 18 is performed.

Similar to the above description with reference to FIG. 5, FIG. 8A illustrates a state in which, after the leading edge part of the cut roll sheet 18 passes through the feed roller pair 16 and the slack forming guide 61 and reaches the nip part (transfer part) between the photosensitive drum 25 and the transfer roller 42C, the roll sheet 18 continues to be carried while maintaining a state of being greatly bent (curved) upward with respect to the virtual carrying path.

On the other hand, FIG. 8B illustrates a traveling path during the traveling cut by the cutter unit 33 when the movement speed of the roll sheet 18 changes in a slowing down direction and illustrates a rotation state of the slack forming guide 61. In this way, during the traveling cut by the cutter unit 33, a tensional force of a curved portion is increased due to that the movement of the roll sheet 18 passing through the cutter unit 33 is slowed. However, as a result, the slack forming guide 61 rotates counterclockwise (in a direction opposite to the arrow C) against a biasing force and is displaced so as to absorb the change in the movement of the roll sheet 18.

In particular, when the roll sheet 18 is a thick sheet, since resistance during the traveling cut is large, the movement of the roll sheet 18 passing through the cutter unit 33 is slower. However, as illustrated in FIG. 8A, since the flexure of the roll sheet 18 is large, the change in the movement of the roll sheet 18 can be sufficiently absorbed.

Figure 9A:
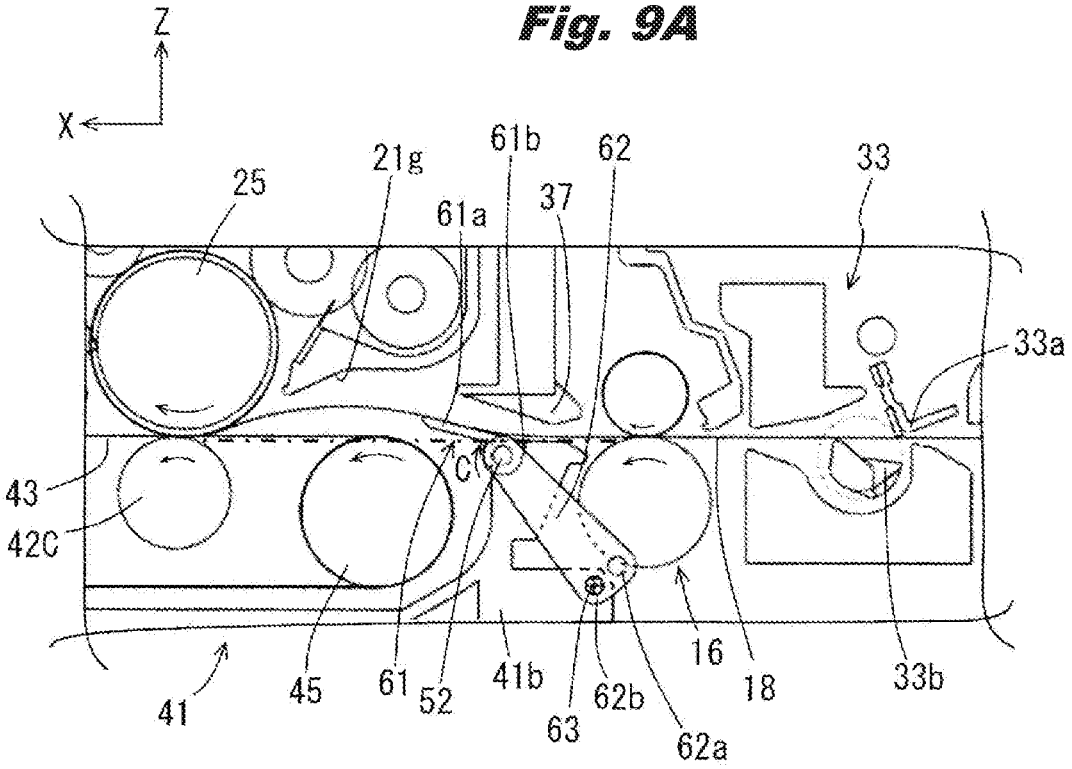
FIGS. 9A and 9B are main part configuration diagrams illustrating a configuration and operating states in the case where a thin roll sheet is used.
Figure 9B:
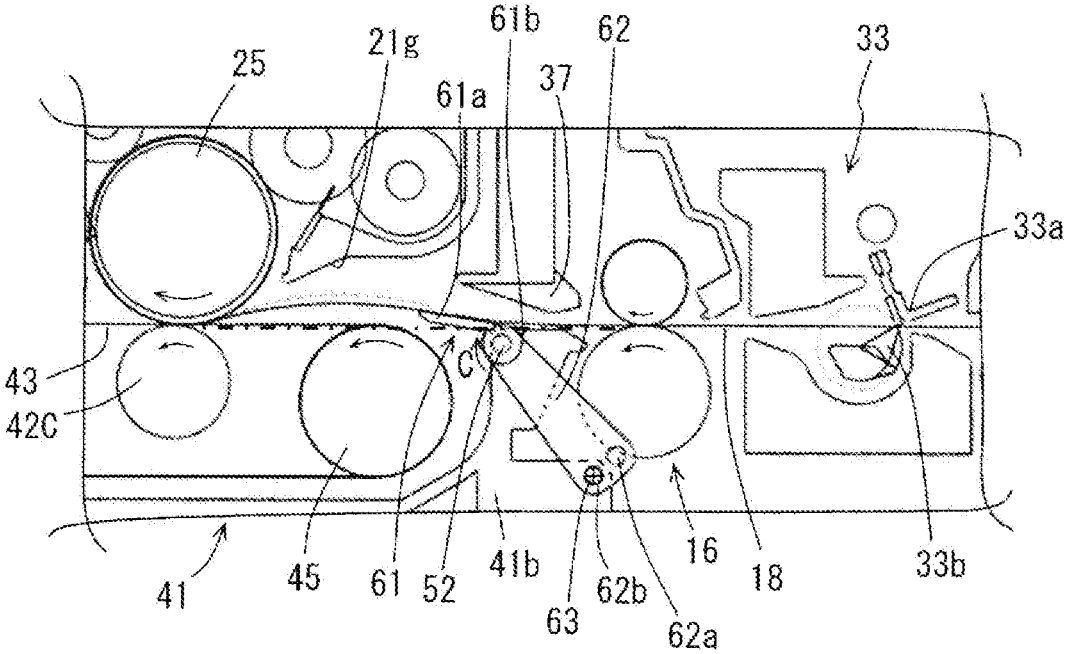

FIGS. 9A and 9B are main part configuration diagrams illustrating a configuration and operating states in the case where a thin roll sheet 18 is used. FIG. 9A illustrates a state when the traveling cut of the roll sheet 18 has not been performed. FIG. 9B illustrates a state when the traveling cut of the roll sheet 18 is performed.

Similar to the above description with reference to FIG. 5, FIG. 9A illustrates a state in which, after the leading edge part of the cut roll sheet 18 passes through the feed roller pair 16 and the slack forming guide 61 and reaches the nip part (transfer part) between the photosensitive drum 25 and the transfer roller 42C, the roll sheet 18 continues to be carried while maintaining a state of being moderately bent (curved) upward with respect to the virtual carrying path.

On the other hand, FIG. 9B illustrates a traveling path during the traveling cut by the cutter unit 33 when the movement speed of the roll sheet 18 changes in a slowing down direction and illustrates a rotation state of the slack forming guide 61. In this way, during the traveling cut by the cutter unit 33, a tensional force of a curved portion is increased due to that the movement of the roll sheet 18 passing through the cutter unit 33 is slowed. However, as a result, the slack forming guide 61 rotates counterclockwise (in a direction opposite to the arrow C) against a biasing force and is displaced so as to absorb the change in the movement of the roll sheet 18.

In particular, when the roll sheet 18 is a thin sheet, as illustrated in FIG. 9A, the flexure is set to be relatively small. However, since the resistance during the traveling cut is small, the decrease in the movement speed of the roll sheet 18 passing through the cutter unit 33 becomes small, and the change in the movement of the roll sheet 18 can be sufficiently absorbed.

According to the apparatus of the second modified embodiment, since the degree of the slack can be selected according to the thickness of the roll sheet 18, slack formation can be set to a minimum necessary range, and thus, it can contribute to the stability of the roll sheet 18 during carrying.

As described above, according to the image forming apparatus of the present embodiment, even when the traveling cut is started while the transfer to the roll sheet 18 is being performed, since the slack forming film 11 or the slack forming guide 61 is displaced accordingly, the movement of the traveling cut can be prevented from affecting the transfer part by the flexure formed in advance.

Second Embodiment

Figure 10:
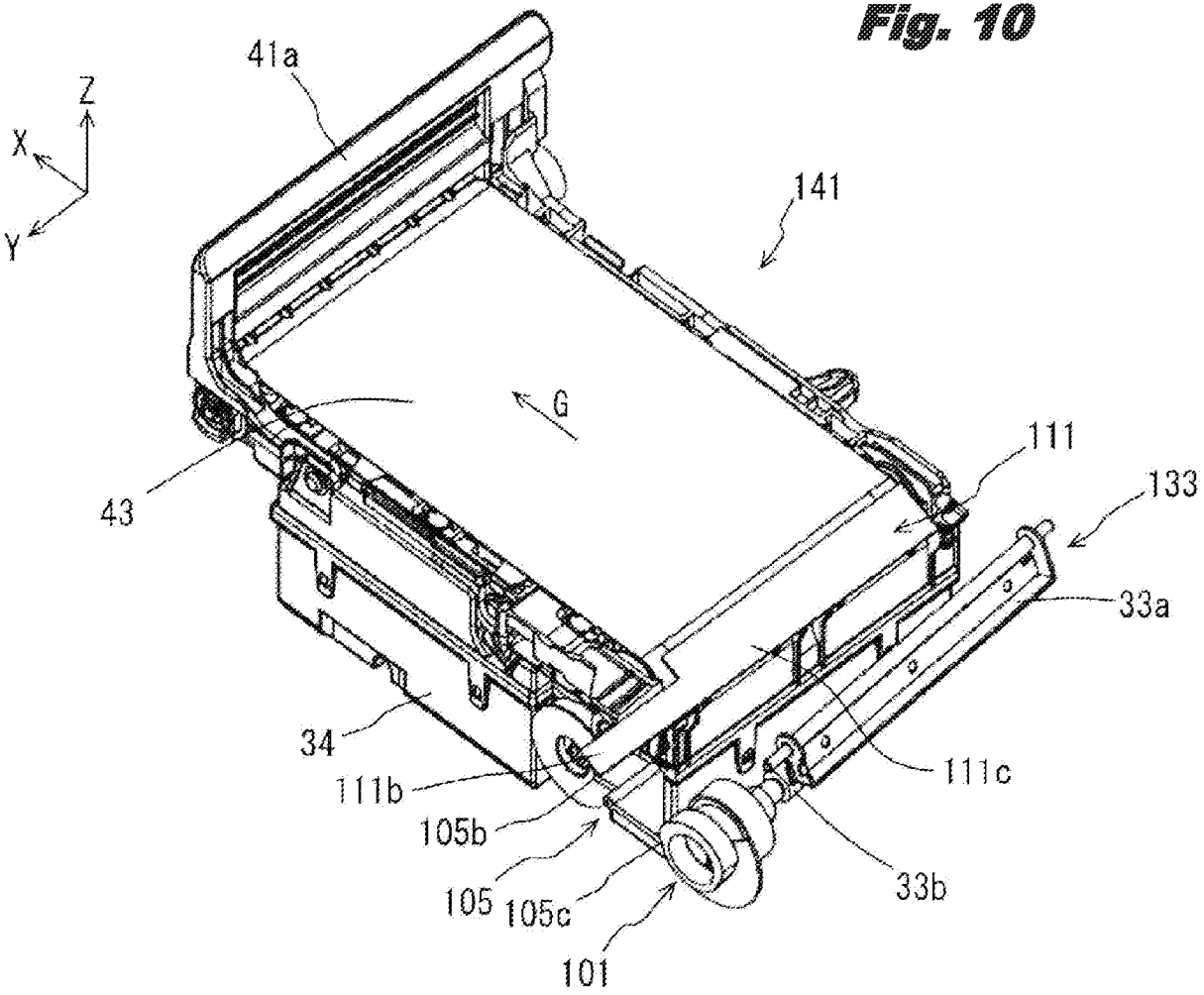
FIG. 10 is an external perspective view of a transfer belt unit and a cutter unit adopted in an image forming apparatus of a second embodiment based on the present invention.
Figure 11:
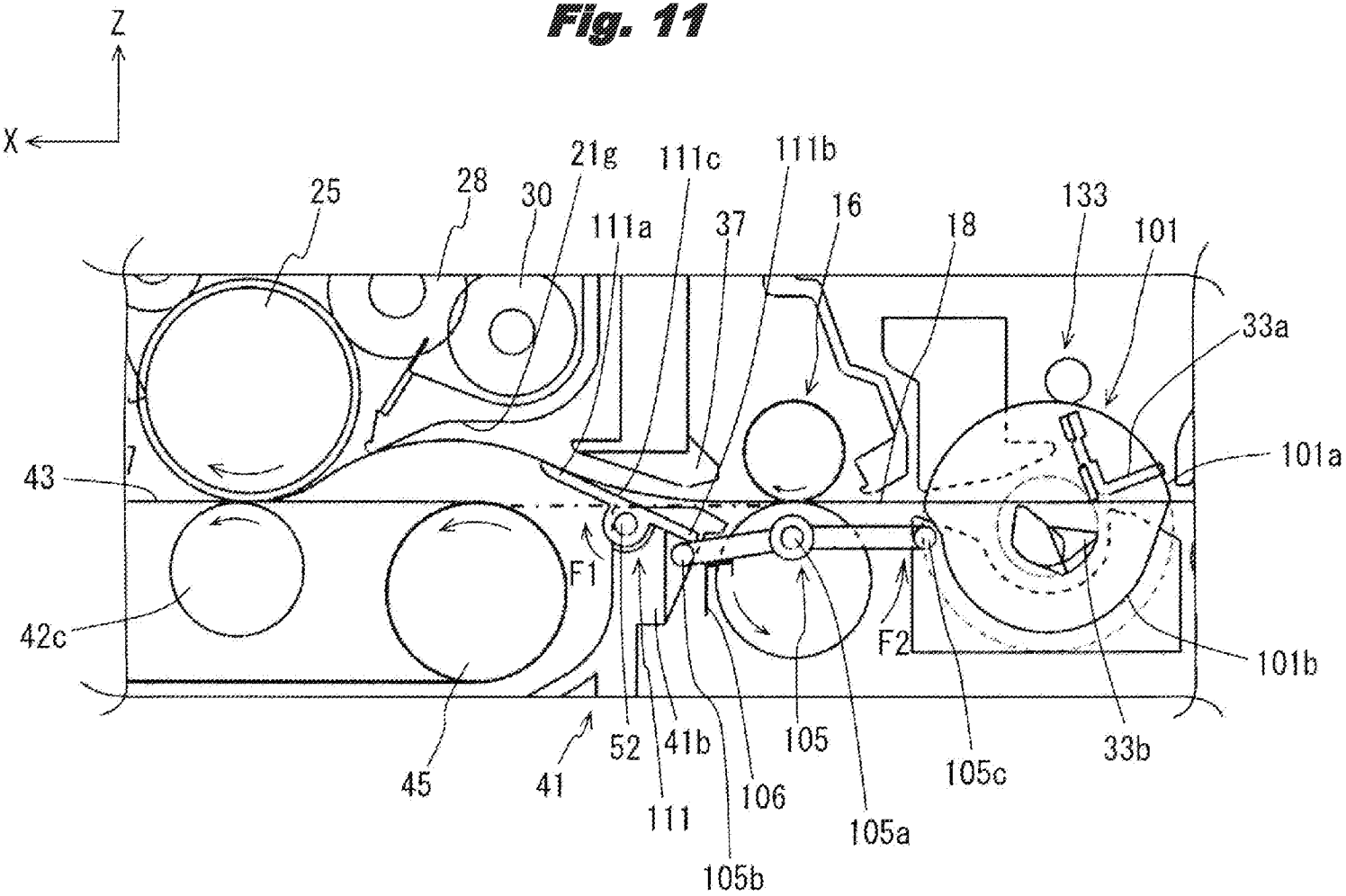
FIG. 11 is a partial enlarged view schematically illustrating an internal configuration of the image forming apparatus of the second embodiment in the same portion as that of FIG. 5 described above.

FIG. 10 is an external perspective view of a transfer belt unit 141 and a cutter unit 133 adopted in an image forming apparatus of a second embodiment based on the present invention. FIG. 11 is a partial enlarged view schematically illustrating an internal configuration of the image forming apparatus of the present embodiment in the same portion as that of FIG. 5 described above.

A slack forming mechanism including the transfer belt unit 141 and the cutter unit 133 is mainly different from the configuration of the first embodiment illustrated in FIG. 5 described above in that a slack forming guide 111, a rotary lever 105 as a rotating member to move the slack forming guide 111, and a cam 101 are added. Therefore, parts of the image forming apparatus adopting this slack forming mechanism that are common to the image forming apparatus 1 (FIG. 3) of the first embodiment described above are indicated using the same reference numeral symbols, or illustration thereof in the drawings is omitted, and description thereof is omitted, and description is given focusing on the differences. Since main configuration elements of the image forming apparatus of the present embodiment are the same as those of the image forming apparatus 1 of the first embodiment illustrated in FIG. 3 except for the slack forming mechanism illustrated in FIG. 11, FIG. 3 is referred to when necessary.

In FIGS. 10 and 11, the slack forming guide 111 is rotatably supported by a caching 141*b* of the transfer belt unit 141 so as to be rotatable around an axis extending in the Y axis direction. A position where the slack forming guide 111 is rotatably supported is near a lower side of the virtual carrying path (indicated by a one-dot chain line in FIG. 11), and it is designed such that, when a guide surface 111*c* of the slack forming guide 111 becomes horizontal, it substantially overlaps with the virtual carrying path.

The rotary lever 105 is held by the caching 141*b* of the transfer belt unit 141 or the main body of the image forming apparatus 1 so as to be rotatable around an axis extending in the Y axis direction. The cam 101 is fixed to the same shaft as that of the rotary blade 33*b* of the cutter unit 33 and has a large-diameter part 101*a* and a small-diameter part 101*b*. Here, the slack forming guide 111, the rotary lever 105 and the cam 101 correspond to a flexure forming part.

As illustrated in FIG. 11, the slack forming guide 111 is biased in a clockwise direction with a biasing force F1 by, for example, a torsion spring (not illustrated in the drawings) arranged on the rotation shaft 52, and a rear end part 111*b* of the slack forming guide 111 is in contact with a one-end part 105*b* of the rotary lever 105 and rotation in the clockwise direction is restricted. This rotary lever 105 is biased with a biasing force F2 in a counterclockwise direction, for example, by a torsion spring (not illustrated in the drawings) arranged on a rotation shaft 105*a*, and rotation in the counterclockwise direction is restricted by an engaging member 106. Further, as will be described later, an other-end part 105*c* of the rotary lever 105 engages with a circumferential surface of the large-diameter part 101*a* of the cam 101 and rotates in a clockwise direction by a predetermined amount against the biasing force F2.

Further, as illustrated in FIG. 11, when the rotary lever 105 is in contact with the engaging member 106, the slack forming guide 111 is at a predetermined rotation position where the guide surface 111*c* protrudes from a lower side to an upper side of the virtual carrying path (indicated by a one-dot chain line in FIG. 11) and toward a downstream side in the sheet carrying direction. Hereinafter, the rotation position of the slack forming guide 111 in this case may be referred to as a slack forming position.

Figure 12:
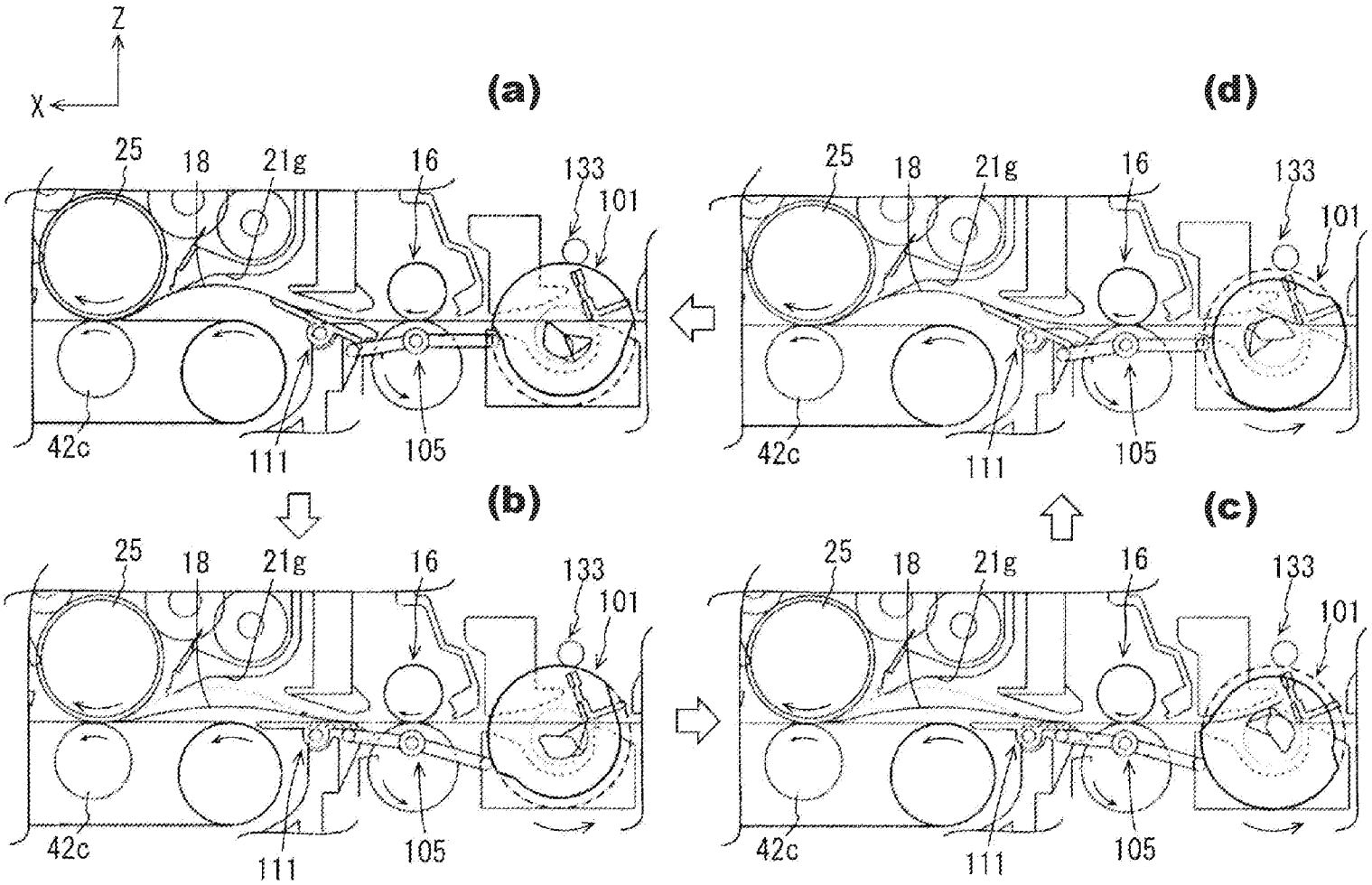
FIG. 12 is for illustrating an operation of a slack forming mechanism of the second embodiment. (a) of FIG. 12 illustrates a state before cutting of the roll sheet. (b) thereof illustrates a state after the cutting is started. (c) thereof illustrates a state at the end of the cutting. (d) thereof illustrates a state after the cutting.

An operation of the slack forming mechanism in the above-described configuration is described with reference to FIG. 12. (a) to (d) of FIG. 12 are for describing an operation of the slack formation mechanism. (a) of FIG. 12 illustrates a state before a traveling cut of the roll sheet 18. (b) of FIG. 12 illustrates a state after the traveling cut is started. (c) of FIG. 12 illustrates a state at the end of the traveling cut. (d) of FIG. 12 illustrates a state after the traveling cut.

As illustrated in (a) of FIG. 12, in a stage before cutting the roll sheet 18, since the other-end part 105*c* of the rotary lever 105 opposes the small-diameter part of the cam 101 and is not acted upon by the cam, the rotary lever 105 is in contact with the engaging member 106 and the slack forming guide 111 stays at the slack forming position. The position of the cam in this case, that is, the rotation position where a portion opposing the other-end part 105*c* of the rotary lever 105 is the small-diameter part 101*b* before moving from the small-diameter part 101*b* to the large-diameter part 101*a* may be referred to as a home position of the cam 101.

In this state, since the leading edge part of the cut roll sheet 18 passes through the feed roller pair 16 and the slack forming guide 51 and reaches the nip part (transfer part) between the photosensitive drum 25 and the transfer roller 42C, after that, as illustrated in (a) of FIG. 12, the roll sheet 18 continues to be carried while maintaining a state of being bent (curved) upward with respect to the virtual carrying path. Here, a portion of the guide surface 111*c* of the slack forming guide 111 that guides the roll sheet 18 corresponds to a guide part.

From this state, as illustrated in (b) of FIG. 12, when the rotary blade 33*b* rotates in the arrow direction and the traveling cut of the roll sheet 18 is started, the other-end part 105*c* of the rotary lever 105 starts to be in contact with the large-diameter part 101*a* of the cam 101 and the rotary lever 105 rotates in the clockwise direction by a predetermined amount against the biasing force F2. By the rotation of the predetermined amount, the slack forming guide 111 also rotates in the counterclockwise direction by a predetermined amount against the biasing force F1, and the guide surface 111*c* of the slack forming guide 111 maintains a horizontal state along the virtual carrying path. Hereinafter, the rotation position of the slack forming guide 111 in this case may be referred to as a normal carrying position. Biasing forces F1 and F2 are shown in FIG. 11.

After that, as illustrated in (c) of FIG. 12, until the traveling cut of the roll sheet 18 is completed, the guide surface 111*c* of the slack forming guide 111 maintains the normal carrying position along the virtual carrying path. On the other hand, during the traveling cut, due to the resistance during the traveling cut, the movement of the roll sheet 18 passing through the cutter unit 33 is slowed. However, since the delay or change in the movement of the roll sheet 18 is absorbed by the flexure of the roll sheet 18 which is in a bent state without being guided, the transfer performed at the nip part (transfer part) between the photosensitive drum 25 and the transfer roller 42C is not affected.

After that, as illustrated in (d) of FIG. 12, the cam 101 continues to rotate to the home position illustrated in (a) of FIG. 12. However, in the process, the rotary lever 105 again becomes in contact with the engaging member 106, and the slack forming guide 111 tries to return to the slack forming position. In this case, a front end part 111*a* of the slack forming guide 111 lifts the roll sheet 18 and brakes the sheet carrying. The front end part 111*a* is shown in FIG. 11.

Here, when the biasing force F1 is reduced, a braking force can be reduced. However, in order to form a flexure, it is necessary to set the biasing force F1 larger than the rigidity of the sheet, and, in order to accommodate a thicker sheet, the biasing force F1 cannot be reduced. Therefore, here, before the other-end part 105*c* of the rotary lever 105 opposes the small-diameter part 101*b* of the cam 101 and the slack forming guide 111 returns to the flexure forming position, a feeding speed of the feed roller pair 16 is accelerated to bend the roll sheet 18 so as to absorb occurrence of braking in this case.

Here, the feeding speed of the feed roller pair 16 is accelerated. However, in FIGS. 12C and 12D, it is also possible to change the shape of the cam 101 or to consider a rotation timing of the cam after the cutting so that the slack forming guide 111 is kept at the normal carrying position illustrated in (c) of FIG. 12 until a trailing edge part of the cut roll sheet 18 passes through the feed roller pair 16. Since the trailing edge part of the cut roll sheet 18 becomes a free trailing edge part once passed through the feed roller pair 16, the carrying of the recording sheet 18' after the cutting is not affected.

First Modified Embodiment of Second Embodiment

Figure 13:
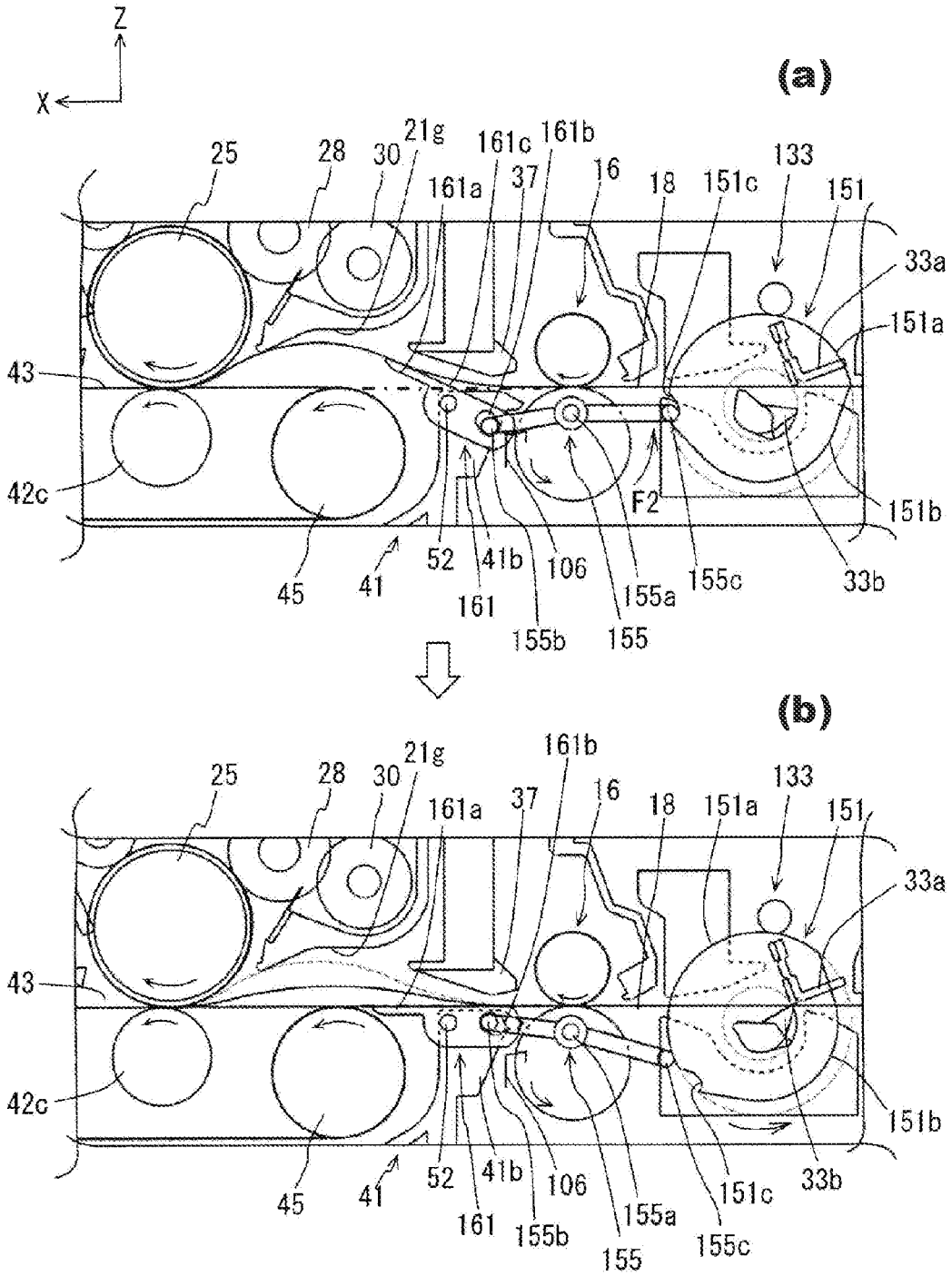
FIG. 13 includes main part configuration diagrams illustrating a configuration and operating states of a first modified embodiment of the second embodiment. (a) of FIG. 13 illustrates a state before cutting of a roll sheet. (b) of FIG. 13 illustrates a state after the cutting of the roll sheet is started.

FIG. 13 is main part configuration diagrams illustrating a configuration and operating states of a first modified embodiment of the second embodiment. (a) of FIG. 13 illustrates a state when the traveling cut of the roll sheet 18 has not been performed. (b) of FIG. 13 illustrates a state when the traveling cut is performed. Main differences between the configuration of the first modified embodiment and the configuration of the second embodiment illustrated in FIG. 11 are, for example, an engaging part between a slack forming guide 161 and a rotary lever 155 and a shape of a cam 151.

That is, in the first modified embodiment of the second embodiment, a long hole 161*b* as an engaging hole is formed at a rear end part of the slack forming guide 161, an engaging protrusion 155*b* as a protrusion formed at a one-end part of the rotary lever 155 biased by a biasing force F2 in a counterclockwise direction fits into the long hole 161*b*, and a locking recess 151*c* is formed at a boundary between a large-diameter part 151*a* and a small-diameter part 151*b* of the cam 151. Here, the slack forming guide 161, the rotary lever 155 and the cam 151 correspond to a flexure forming part.

As illustrated in (a) of FIG. 13, when the engaging protrusion 155*b* of the rotary lever 155 biased in the counterclockwise direction is in contact with one end side of the long hole 161*b* of the slack forming guide 161, the slack forming guide 161 is at a slack forming position where a guide surface 161*c* of the slack forming guide 161 protrudes from a lower side to an upper side of the virtual carrying path (indicated by a one-dot chain line in (a) of FIG. 13) and toward a downstream side in the sheet carrying direction. In other words, the guide surface 161*c* is illustrated, in the drawing, being inclined from the upper left to the lower right. Then, as illustrated in (a) of FIG. 13, when a rotation position of the cam 151 is at a home position, an other-end part 155*c* of the rotary lever 155 is in a state of being accommodated in the locking recess 151*c* of the cam 151.

Further, as illustrated in (a) of FIG. 13, in a stage before the traveling cut of the roll sheet 18, the rotary lever 155 is in contact with the engaging member 106, the slack forming guide 161 stays at the slack forming position, and the rotary lever 155 fits into the locking recess 151*c* of the cam 151 and is restricted from rotating in the clockwise direction.

In this state, since the leading edge part of the cut roll sheet 18 passes through the feed roller pair 16 and the slack forming guide 161 and reaches the nip part (transfer part) between the photosensitive drum 25 and the transfer roller 42C, after that, as illustrated in (a) of FIG. 13, the roll sheet 18 continues to be carried while maintaining a state of being bent (curved) upward with respect to the virtual carrying path. Here, a portion of the guide surface 161*c* of the slack forming guide 161 that guides the roll sheet 18 corresponds to a guide part.

In this case, the slack forming guide 161 receives a force in the clockwise direction due to weight, rigidity or the like of the sheet and tries to rotate the rotary lever 155 in the clockwise direction against the biasing force F2. However, since the rotation in the clockwise direction is prevented by the cam 101, the slack forming guide 161 can continue to stably guide the bent roll sheet 18.

It is also possible to keep the slack forming guide 161 at the slack forming position by setting a strong biasing force F2. However, when the biasing force F2 is increased, a load on the cam 151 is increased and a problem in durability occurs. Therefore, it is not preferable to increase the biasing force F2 too much.

From this state, as illustrated in (b) of FIG. 13, when the rotary blade 33*b* rotates in the arrow direction and the traveling cut of the roll sheet 18 is started, the other-end part 155*c* of the rotary lever 155 starts to be in contact with the large-diameter part 151*a* of the cam 151 and the rotary lever 155 rotates in the clockwise direction by a predetermined amount against the biasing force F2. By the rotation of the predetermined amount, the slack forming guide 161 engaging with the rotary lever 155 also rotates in the counter-clockwise direction by a predetermined amount, and the guide surface 161*c* of the slack forming guide 161 maintains a normal carrying position (horizontal state) along the virtual carrying path.

Since the subsequent operation is similar to the operation described with reference to (c) and (d) of FIG. 12 in the second embodiment, the description thereof is omitted here.

As described above, according to the configuration of the first modified embodiment, since a device biasing the slack forming guide 161 is not required, the configuration is simple, and further, the stability of the slack forming guide 161 at the slack formation position can be improved.

Second Modified Embodiment of Second Embodiment

Figure 14A:
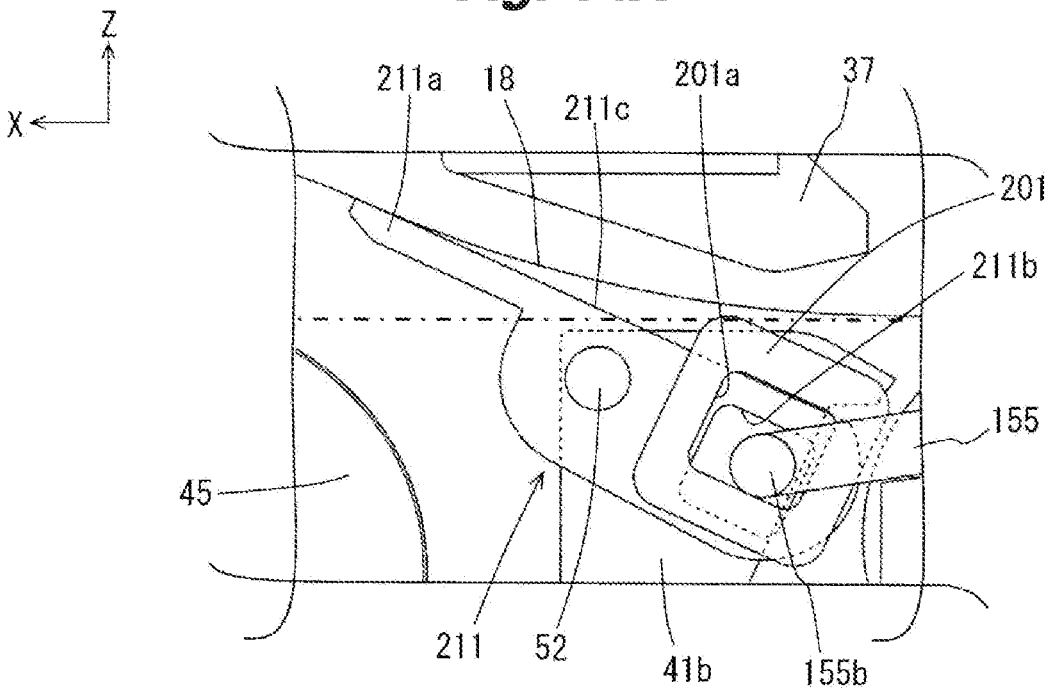
FIGS. 14A and 14B are main part configuration diagrams illustrating a configuration of a second modified embodiment of the second embodiment.
Figure 14B:
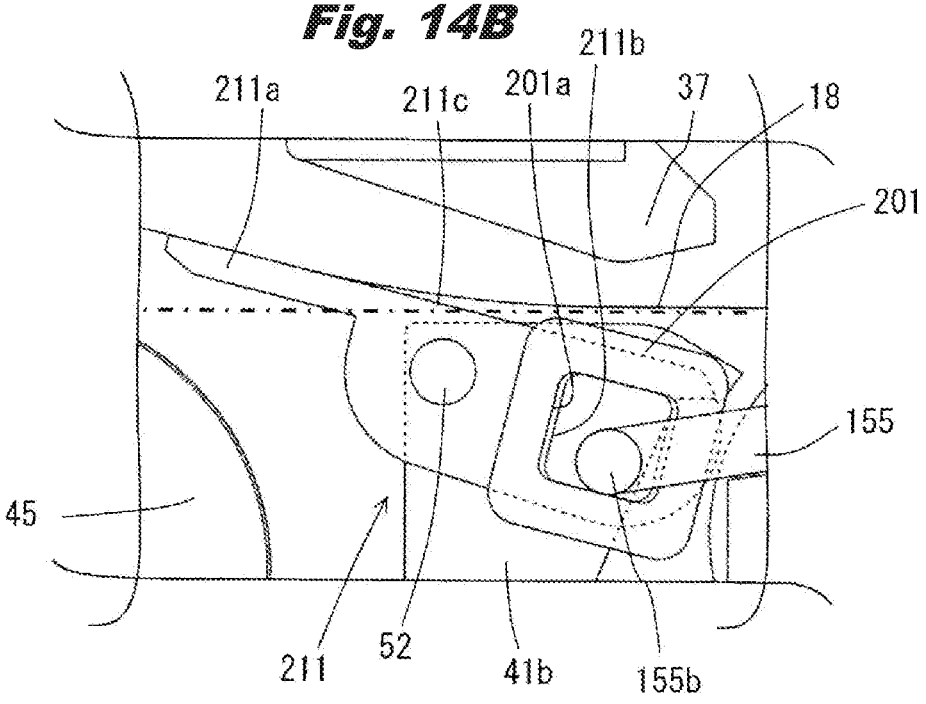

FIGS. 14A and 14B are main part configuration diagrams illustrating a configuration of a second modified embodiment of the second embodiment. FIG. 14A illustrates a state when a thick roll sheet 18 is used and a traveling cut has not been performed. FIG. 14B illustrates a state when a thin roll sheet 18 is used and a traveling cut has not been performed. The second modified embodiment is different from the configuration of the first modified embodiment illustrated in FIGS. 13A and 13B, for example, in that a hole shape of an engaging hole 211*b* (corresponding to the long hole 161*b* in the first modified embodiment) of a slack forming guide 211 can be adjusted by an adjustment plate 201 as an adjustment member.

That is, in the second modified embodiment, the engaging hole 211*b*, which is formed on a rear end part of the slack forming guide 211 and into which the engaging protrusion 155*b* of the rotary lever 155 is fitted, is formed in a substantially square shape in an orientation in which one side thereof is parallel to a guide surface 211*c*, and a length of the one side is set to be substantially equal to a width in a longitudinal direction of the long hole 161*b* of the slack forming guide 211 illustrated in FIGS. 13A and 13B.

The adjustment plate 201 has an opening 201*a* overlapping with the engaging hole 211*b* and is held by the slack forming guide 211 so as to slidable in a direction orthogonal to the guide surface 211*c*, and can be selectively fixed at a first position where, as illustrated in FIG. 14A, a lower side of the engaging hole 211*b* is covered and the engaging hole 211*b* has a substantially long hole shape, and at a second position where, as illustrated in FIG. 14B, the engaging hole 211*b* is fully open and has a substantially square shape.

When the adjustment plate 201 is set to the first position, as illustrated in FIG. 14A, an inclination angle of the guide surface 211*c* of the slack forming guide 211 with respect to the virtual carrying path (indicated by a one-dot chain line in FIG. 14A) becomes large, and the slack of the roll sheet 18 to be carried becomes large. When the adjustment plate 201 is set to the second position, as illustrated in FIG. 14B, the inclination angle of the guide surface 211*c* of the slack forming guide 211 with respect to the virtual carrying path (indicated by a one-dot chain line in FIG. 14B) becomes small, and the slack of the roll sheet 18 to be carried becomes small.

As will be described later, when the roll sheet 18 is a thick sheet, the adjustment plate 201 is selectively fixed at the first position so that the slack of the rolled sheet 18 to be carried is relatively large, and when the roll sheet 18 is a thin sheet, the adjustment plate 201 is selectively fixed at the second position so that the slack of the rolled sheet 18 to be carried is small.

Figure 15A:
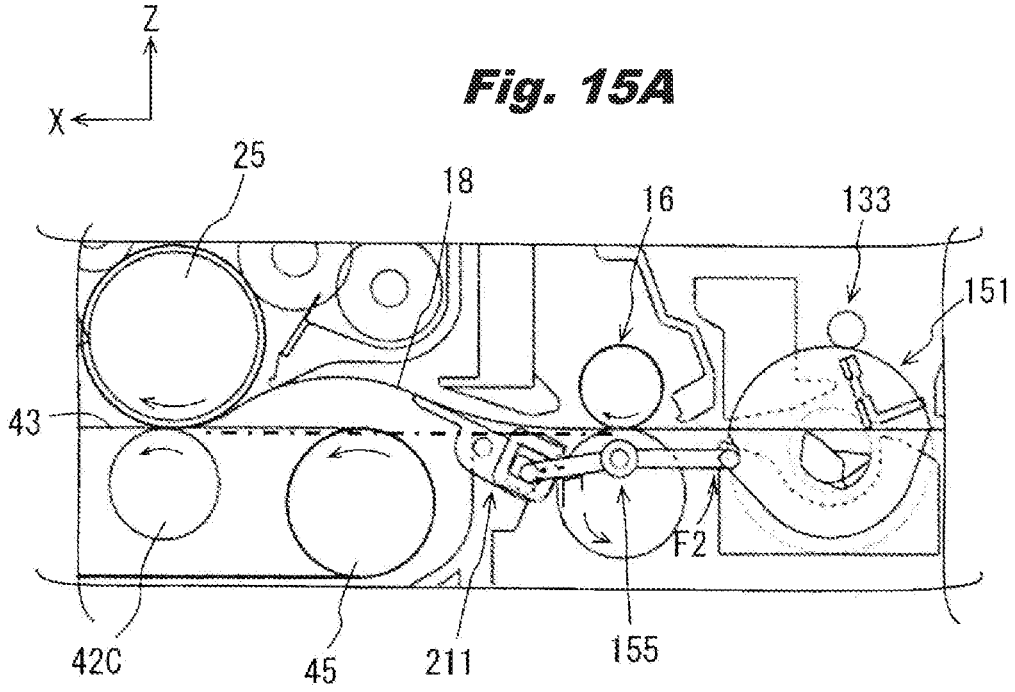
FIGS. 15A and 15B are main part configuration diagrams illustrating a configuration and operating states in the case where a thick roll sheet is used.
Figure 15B:
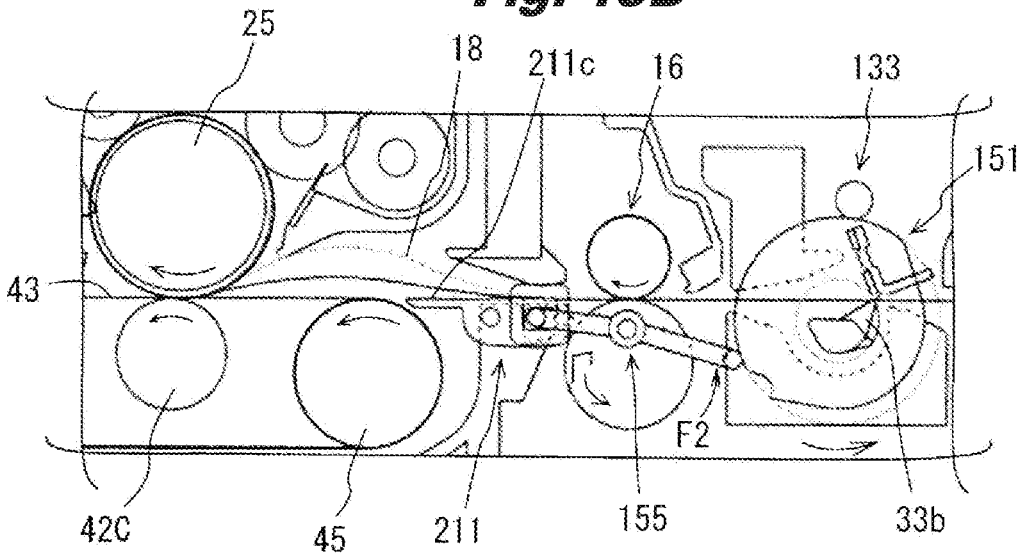

FIGS. 15A and 15B are main part configuration diagrams illustrating a configuration and operating states in the case where a thick roll sheet 18 is used. FIG. 15A illustrates a state when the traveling cut of the roll sheet 18 has not been performed. FIG. 15B illustrates a state when the traveling cut of the roll sheet 18 is performed. Here, the slack forming guide 211, the rotary lever 155 and the cam 151 correspond to a flexure forming part.

Similar to the above description with reference to (a) of FIG. 13, FIG. 15A illustrates a state in which, after the leading edge part of the cut roll sheet 18 passes through the feed roller pair 16 and the slack forming guide 211 and reaches the nip part (transfer part) between the photosensitive drum 25 and the transfer roller 42C, the roll sheet 18 continues to be carried while maintaining a state of being greatly bent (curved) upward with respect to the virtual carrying path.

From this state, as illustrated in FIG. 15B, when the rotary blade 33*b* rotates in the arrow direction and the traveling cut of the roll sheet 18 is started, the other-end part 155*c* of the rotary lever 155 starts to be in contact with the large-diameter part 151*a* of the cam 151 and the rotary lever 155 rotates in the clockwise direction by a predetermined amount against the biasing force F2. By the rotation of the predetermined amount, the slack forming guide 211 engaging with the rotary lever 155 also rotates in the counter-clockwise direction by a predetermined amount, and the guide surface 211*c* of the slack forming guide 211 maintains a normal carrying position (horizontal state) along the virtual carrying path.

Figure 16A:
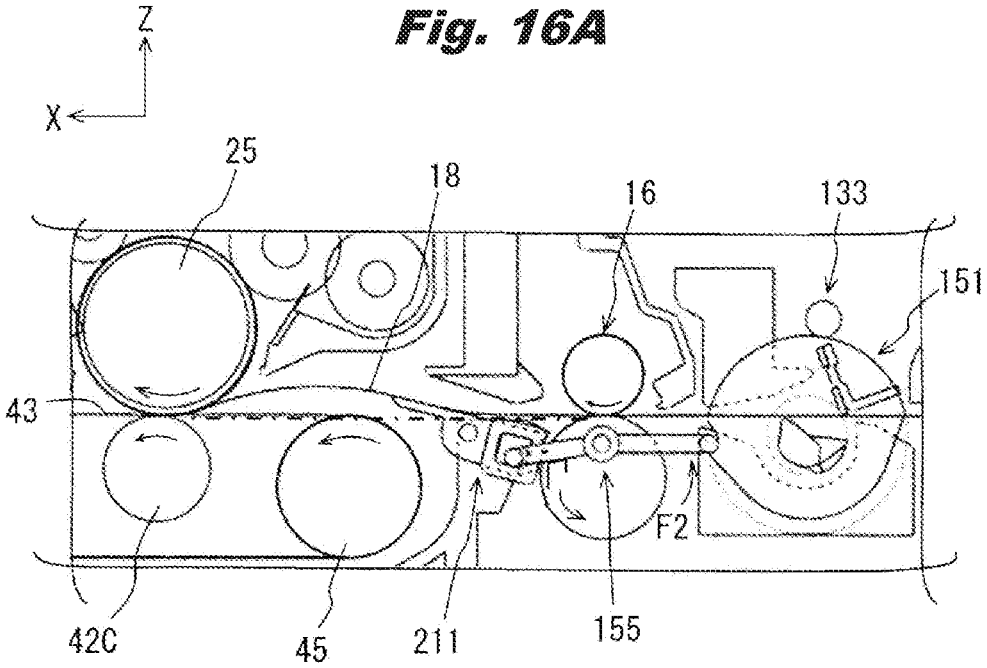
FIGS. 16A and 16B are main part configuration diagrams illustrating a configuration and operating states in the case where a thin roll sheet is used.
Figure 16B:
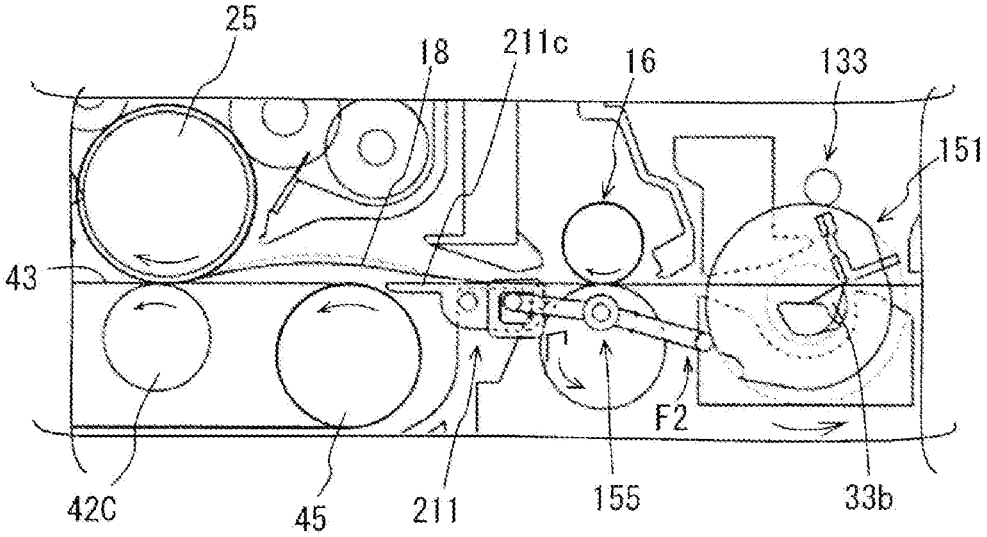

FIGS. 16A and 16B are main part configuration diagrams illustrating a configuration and operating states in the case where a thin roll sheet 18 is used. FIG. 16A illustrates a state when the traveling cut of the roll sheet 18 has not been performed. FIG. 16B illustrates a state when the traveling cut of the roll sheet 18 is performed.

Similar to the above description with reference to (a) of FIG. 13, FIG. 16A illustrates a state in which, after the leading edge part of the cut roll sheet 18 passes through the feed roller pair 16 and the slack forming guide 211 and reaches the nip part between the photosensitive drum 25 and the transfer roller 42C, the roll sheet 18 continues to be carried while maintaining a state of being moderately bent (curved) upward with respect to the virtual carrying path.

From this state, as illustrated in FIG. 16B, when the rotary blade 33*b* rotates in the arrow direction and the traveling cut of the roll sheet 18 is started, in the same way as that described with reference to FIG. 15B, the guide surface 211*c* maintains the normal carrying position (horizontal state) along the virtual carrying path.

In particular, when the roll sheet 18 is a thin sheet, as illustrated in FIG. 16A, the flexure is set to be relatively small. However, since the resistance during the traveling cut is small, the decrease in the movement speed of the roll sheet 18 passing through the cutter unit 33 is also small, and the change in the movement of the roll sheet 18 can be sufficiently absorbed.

According to the apparatus of the second modified embodiment, since the degree of the slack can be selected according to the thickness of the roll sheet 18, slack formation can be set to a minimum necessary range, and thus, it can contribute to the stability of the roll sheet 18 during carrying.

As described above, according to the image forming apparatus of the present embodiment, even when the traveling cut is started while the transfer to the roll sheet 18 is being performed, before that, the slack forming guide (111, 161, 211) returns from the slack forming position to the normal carrying position. Therefore, the movement of the traveling cut can be prevented from affecting the transfer part by the flexure formed in advance.

Further, in the above description of the embodiments, the terms "up," "down," "left," "right," "front," and "rear" are used. However, these terms are used for convenience, and do not limit an absolute positional relationship in a state in which the image forming apparatus is arranged.

In the present embodiment, as the image forming apparatus, a tandem color printer having multiple development units is described as an example. However, in addition to a color printer, the present invention is also useful for an image forming apparatus such as a copying machine, a FAX, or an MFP (Multi Function Peripheral) that combines the functions of these apparatuses. Further, the present invention is also useful for a monochrome image forming apparatus having one image forming unit.

FIGS. 5-9 illustrate embodiments in which the guide part performs the retreat movement when the cutting part starts to cut the medium. More specifically, the guide part may start to perform the retreat movement after the cutting part starts to cut the medium. It may be preferred that the guide part starts the retreat movement before the cutting part completes to cut the medium. FIGS. 11-16B illustrates other embodiments in which the guide part performs the retreat movement when the cutting part starts to cut the medium. In the other embodiments, the guide part may start the retreat movement before or after the cutting part starts to cut the medium. In the invention, the above "before" includes a timing that the guide part performs the retreat movement slightly before or almost at the same timing as the cutting.

The timing at which the cutting part starts to cut the medium may be determined when the cutting blade of the cutting part touches the medium or when the cutting blade starts or is activated to move.

While the cutting part is cutting the medium, the guide part may stay at a retreat position, which is different from the home position, or may gradually return to the home position from the retreat position as the medium is being cut. The guide part is configured to pivot between the retreat position and the home position. The retreat position is illustrated, for example, in FIGS. 6B, 8B, 9B, 15B and 16B.

What is claimed is:

1. An image forming apparatus, comprising:

a cutting part that cuts a medium, the medium being carried along a carrying path in a carrying direction;

a transfer part that is arranged on a downstream side of the cutting part in the carrying direction of the medium and transfers a developer image to the medium;

a medium carrying part that is positioned between the cutting part and the transfer part and that carries the medium;

a flexure forming part that has a guide part for guiding the medium to be carried along the carrying path, and forms a flexure of the medium by bending the medium between the medium carrying part and the transfer part in the carrying direction; and an opposing part that is arranged opposing the flexure forming part via a carrying path through which the medium is carried, wherein the guide part performs a retreat movement either before or after the cutting part starts to cut the medium, wherein the retreat movement is a movement of the guide part in which the guide part moves in a direction away from the opposing part.

2. The image forming apparatus according to claim 1, wherein the retreat movement is performed due to a change of a tensional force of the medium, wherein the change of the tensional force occurs during the cutting part cuts the medium.

3. The image forming apparatus according to claim 2, wherein the flexure forming part is formed of a flexible member.

4. The image forming apparatus according to claim 3, wherein the flexure forming part includes a support part that supports the guide part, and the guide part includes a fixed end part that is fixed to the support part and an other end part that moves in a direction away from the opposing part.

5. The image forming apparatus according to claim 2, wherein the flexure forming part is rotatably held in a state of being biased in one direction.

6. The image forming apparatus according to claim 5, wherein the flexure forming part includes:

a guide member that is rotatably held in a state of being biased in the one direction; and a restriction member that restricts a rotation of the guide member in the one direction, and the restriction member is configured to selectively select the predetermined rotation position from multiple rotation positions.

7. The image forming apparatus according to claim 1, wherein the guide part starts to perform the retreat movement before the medium is cut in the cutting part.

8. An image forming apparatus, comprising:

a cutting part that cuts a medium, the medium being carried along a carrying path in a carrying direction;

a transfer part that is arranged on a downstream side of the cutting part in the carrying direction of the medium and transfers a developer image to the medium;

a flexure forming part that has a guide part for guiding the medium to be carried along the carrying path, and forms a flexure of the medium by bending the medium between the cutting part and the transfer part in the carrying direction; and an opposing part that is arranged opposing the flexure forming part via a carrying path through which the medium is carried, wherein the guide part performs a retreat movement either before or after the cutting part starts to cut the medium, wherein the retreat movement is a movement of the guide part in which the guide part moves in a direction away from the opposing part, the cutting part includes a fixed blade which is stable and a rotary blade that rotates, the flexure forming part includes:

a slack forming guide that is rotatably held and guides the medium;

a rotating member that is rotatably held, having two end parts, wherein one-end part of the rotation member engages with the slack forming guide; and a cam that coaxially rotates with the rotary blade and engages with the other-end part of the rotating member, and the guide part performs the retreat movement in correspondence with a rotation of the cam before the cutting.

9. The image forming apparatus according to claim 8, wherein a protrusion is formed on one of the slack forming guide and the rotating member has and an engaging hole is formed on the other of the slack forming guide and the rotating member, and in an engaging part, the slack forming guide engages with the rotating member by the protrusion fitting into the engaging hole.

10. The image forming apparatus according to claim 9, wherein a movement region of the protrusion that fits into the engaging hole is configured to be selectively selected from multiple movement regions.

11. The image forming apparatus according to claim 10, further comprising:

an adjustment member that limits a region in which the protrusion is configured to move in the engaging hole.

12. An image forming apparatus, comprising:

a cutting part that cuts a medium;

a transfer part that is arranged on a downstream side of the cutting part in a carrying direction of the medium and transfers a developer image to the medium;

a medium carrying part that is positioned between the cutting part and the transfer part; and a flexible member that guides the medium and forms a flexure of the medium between the medium carrying part and the transfer part in the carrying direction.

* * * * *